US009290005B1

(12) United States Patent
Akiyama et al.

(10) Patent No.: US 9,290,005 B1
(45) Date of Patent: Mar. 22, 2016

(54) IMAGE FORMATION APPARATUS, METHOD FOR EXAMINING DISCHARGE OF TRANSPARENT DROPLETS, AND PROGRAM FOR EXAMINING DISCHARGE OF TRANSPARENT DROPLETS

(71) Applicants: Yoshitaka Akiyama, Kanagawa (JP); Ryuuta Katoh, Kanagawa (JP); Kazuki Yasu, Tokyo (JP); Yoshinari Suzuki, Kanagawa (JP)

(72) Inventors: Yoshitaka Akiyama, Kanagawa (JP); Ryuuta Katoh, Kanagawa (JP); Kazuki Yasu, Tokyo (JP); Yoshinari Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/849,457

(22) Filed: Sep. 9, 2015

(30) Foreign Application Priority Data

Sep. 11, 2014 (JP) ..... 2014185659
Jul. 10, 2015 (JP) ..... 2015139226

(51) Int. Cl.
*B41J 2/21* (2006.01)

(52) U.S. Cl.
CPC ..... *B41J 2/2103* (2013.01); *B41J 2/2135* (2013.01); *B41J 2/2146* (2013.01)

(58) Field of Classification Search
CPC .. B41J 2202/20; B41J 2/1404; B41J 2202/21; B41J 2/1433; B41J 2/145; B41J 2/2135; B41J 2/2146
See application file for complete search history.

(56) References Cited

U.S. PATENT DOCUMENTS

| | | | | |
|---|---|---|---|---|
| 6,113,218 | A | 9/2000 | Atobe et al. | |
| 7,506,960 | B2 * | 3/2009 | Chikanawa | B41J 2/1433 347/42 |
| 8,136,902 | B2 | 3/2012 | Miyagi et al. | |
| 8,967,753 | B2 | 3/2015 | Suzuki et al. | |
| 2013/0293645 | A1 | 11/2013 | Yasu et al. | |

FOREIGN PATENT DOCUMENTS

| | | |
|---|---|---|
| JP | S61-059911 | 3/1986 |
| JP | H06-071882 | 3/1994 |
| JP | H11-342603 | 12/1999 |
| JP | 2000-141624 | 5/2000 |
| JP | 2000-168106 | 6/2000 |
| JP | 2012-035446 | 2/2012 |
| JP | 2013-248882 | 12/2013 |

* cited by examiner

*Primary Examiner* — Thinh Nguyen
(74) *Attorney, Agent, or Firm* — Duft Bornsen & Fettig LLP

(57) ABSTRACT

An image formation apparatus includes a first discharge unit to form an image on a recording medium; and a second discharge unit including a nozzle line that discharges transparent droplets on the image formed on the recording medium. The second discharge unit moves in a first direction relative to the recording medium and the nozzle line has nozzles in a second direction orthogonal to the first direction. After the image formation, the second discharge unit discharges the transparent droplets from the nozzles spaced at m−1 nozzle intervals to form a row of dots in the second direction, and repeats the forming while moving to form m rows in the first direction, such that the dots in the rows are formed at m−1 nozzle intervals and positions of the dots between n-th and n−1-th rows are displaced together by one nozzle in the second direction.

13 Claims, 28 Drawing Sheets n=3

IMAGE FORMATION APPARATUS, METHOD FOR EXAMINING DISCHARGE OF TRANSPARENT DROPLETS, AND PROGRAM FOR EXAMINING DISCHARGE OF TRANSPARENT DROPLETS

CROSS-REFERENCE TO RELATED APPLICATIONS

The present application is based on and claims the benefit of priorities of Japanese Priority Application No. 2014-185659 filed on Sep. 11, 2014 and Japanese Priority Application No. 2015-139226 filed on Jul. 10, 2015, the entire contents of which are hereby incorporated by reference.

BACKGROUND OF THE INVENTION

1. Field of the Invention

The present invention relates to an image formation apparatus, a method for examining a discharge of transparent droplets, and a program for examining the discharge of transparent droplets.

2. Description of the Related Art

It is difficult to visually observe patterns formed with transparent droplets unlike patterns formed with color ink droplets.

Some documents describe a technique of performing registration adjustment through detection of recording positions of transparent droplets by a detection unit based on the fact that if transparent droplets are placed on color ink when printing is performed, color is different from a case where printing is performed with only the color ink (see Patent Documents 1 and 2, for example).

However, it is difficult to visually detect nozzle clogging or a curved discharge from multiple patterns formed with transparent droplets discharged from multiple nozzles.

[Patent Document 1] Japanese Laid-Open Patent Application No. 2012-035446

[Patent Document 2] Japanese Laid-Open Patent Application No. 2000-141624

SUMMARY OF THE INVENTION

It is a general object of at least one embodiment of the present invention to provide an image formation apparatus capable of improving visibility of patterns formed with transparent droplets discharged from multiple nozzles.

In an embodiment, an image formation apparatus is provided. The image formation apparatus includes a first discharge unit including a first nozzle line having a plurality of nozzles, the first nozzle line discharging color droplets to form a predetermined image on a recording medium, the first discharge unit moving relative to the recording medium; and a second discharge unit including a second nozzle line that discharges transparent droplets on the recording medium on which the predetermined image is formed, the second discharge unit moving in a first direction relative to the recording medium, and the second nozzle line having a plurality of nozzles arranged in a second direction orthogonal to the first direction. When a discharge operation of the second discharge unit is examined, after the predetermined image is formed with the color droplets discharged by the first discharge unit, the second discharge unit discharges the transparent droplets from two or more of the nozzles thereof spaced at m−1 nozzle intervals in the second direction to form a row of dots extending in the second direction, and repeats forming the rows while successively moving in the first direction relative to the recording medium so as to form m rows arranged side by side in the first direction, positions of the discharging nozzles being successively shifted together by one nozzle in the second direction upon a successive movement of the second discharge unit relative to the recording medium in the first direction, such that the dots in each of the rows are formed at m−1 nozzle intervals, and positions of the dots in an n-th one of the rows are displaced together by one nozzle in the second direction relative to positions of the dots in an n−1-th one of the rows.

According to an embodiment, it is possible to improve visibility of patterns formed with transparent droplets discharged from multiple nozzles.

BRIEF DESCRIPTION OF THE DRAWINGS

Other objects and further features of embodiments will become apparent from the following detailed description when read in conjunction with the accompanying drawings, in which.

Figure 1:
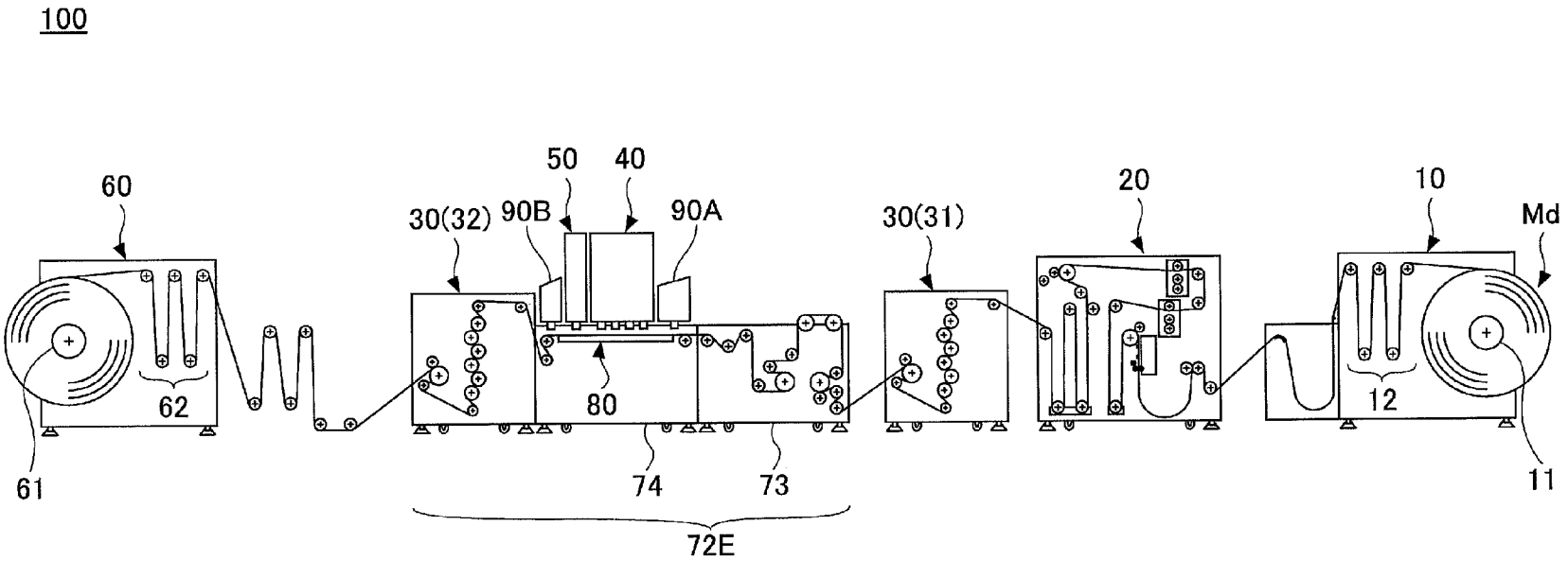
FIG. 1 is a schematic side view showing an image formation apparatus according to an embodiment of the present invention.

DESCRIPTION OF THE PREFERRED EMBODIMENTS (Configuration of Image Formation Apparatus)

An image formation apparatus 100 according to an embodiment of the present invention will be described with reference to FIGS. 1-5B. In the present embodiment, the image formation apparatus 100 has a discharge head (recording head, ink head) of four colors: black (K), cyan (C), magenta (M), and yellow (Y). However, image formation apparatuses to which the present invention can be applied are not limited to those image formation apparatuses having such a discharge head. In other words, image formation apparatuses to which the present invention can be applied include those image formation apparatuses further having a discharge head for green (G), red (R), light cyan (LC), and/or another color or having only a discharge head for black (K). In the following description, a reference numeral provided with K, C, M, or Y as a suffix is assumed to correspond to black, cyan, magenta, or yellow, respectively.

Further, although rolled continuous paper is used as a recording medium (hereafter "roll paper Md") in the present embodiment, recording mediums on which the image formation apparatus 100 according to the present invention can form an image are not limited to the roll paper Md. In other words, recording media on which the image formation apparatus 100 according to the present invention can form an image may include cut paper. Further, recording media on which the image formation apparatus 100 according to the present invention can form an image may include regular paper, high-quality paper, thin paper, cardboard, recording paper, roll paper, OHP sheet, synthetic resin film, metallic thin film, and other materials on which an image can be formed using ink or the like. The roll paper Md here includes continuous paper (continuous sheets, continuous form paper) in which perforations that allow cutting are formed at predetermined intervals. Further, a page in the roll paper Md is assumed to be a region between the perforations formed at predetermined intervals, for example.

As shown in FIG. 1, the image formation apparatus 100 according to the embodiment of the present invention includes a carrying-in unit 10 that carries in the roll paper Md (recording medium), a pretreatment unit 20 that pretreats the roll paper Md that has been carried in, and a drying unit 30 that dries the roll paper Md that has been pretreated. Further, the image formation apparatus 100 includes an image formation unit 40 that forms an image on a surface of the roll paper Md, a post-treatment unit 50 that performs post-treatment on the roll paper Md on which the image is formed, and a carrying-out unit 60 that carries out the roll paper Md that has been subjected to the post-treatment. The image formation unit 40, the post-treatment unit 50, and maintenance and recovery units 90A and 90B are disposed on a case 74 of a printer engine 72E. The case 74 serving as an inkjet printer body includes a carrying unit 80 having a carrying belt 81 or the like. The image formation unit 40, the post-treatment unit 50, the maintenance and recovery units 90A and 90B, cases 73 and 74, and a post-treatment drying unit 32 correspond to the printer engine 72E to be described later. Further, the image formation apparatus 100 includes a control unit 70 (see FIG. 11) that controls operations of the image formation apparatus 100.

In the image formation apparatus 100 according to the present embodiment, the carrying-in unit 10 carries in roll paper Md, the pretreatment unit 20 pretreats a surface of the roll paper Md, and the drying unit 30 dries the surface of the roll paper Md. Further, in the image formation apparatus 100, the image formation unit 40 forms an image on the surface of the roll paper Md that has been pretreated and dried. Further, in the image formation apparatus 100, the post-treatment unit 50 performs post-treatment on the roll paper Md on which the image is formed. Then, in the image formation apparatus 100, the carrying-out unit 60 rolls up (ejects, carries out) the roll paper Md.

In the following, each configuration of the image formation apparatus 100 according to the embodiment of present invention will be specifically described. The image formation apparatus 100 to which the present invention is applied may be configured without including one or more of the pretreatment unit 20 and the like described below depending on a type of the recording medium on which the image is formed.

(Configuration of Carrying-in Unit)

The carrying-in unit 10 carries the recording medium to the pretreatment unit 20, for example. In the present embodiment, the carrying-in unit 10 is configured with a paper feeding unit 11 and a plurality of carrying rollers 12. The carrying-in unit 10 uses the carrying rollers 12 to carry in (move) the roll paper Md rolled up and held on a paper feeding roller of the paper feeding unit 11 and carries the roll paper Md to the pretreatment unit 20 using a platen, for example.

(Configuration of Pretreatment Unit)

The pretreatment unit 20 pretreats the recording medium before an image is formed. In the present embodiment, the pretreatment unit 20 pretreats a surface of the roll paper Md with a pretreatment liquid, the roll paper Md been carried in by the carrying-in unit 10.

The pretreatment here refers to treatment to evenly coat the surface of the roll paper Md (recording medium) with the pretreatment liquid that has a function of coagulating ink. In accordance with this, when the image formation apparatus 100 forms an image on paper exclusively used for inkjet printing or on a recording medium other than such an exclusive paper, the image formation apparatus 100 can coat the surface of the recording medium with the pretreatment liquid that has the function of coagulating ink by using the pretreatment unit 20 before the image is formed on the recording medium.

Accordingly, the image formation apparatus 100 is capable of reducing generation of a quality problem in an image to be formed involving blur, density, color tone, and set-off and reducing generation of a problem related to water resistance, weatherability, and image fastness. Accordingly, it is possible to improve quality of an image to be formed thereafter.

Figure 2:
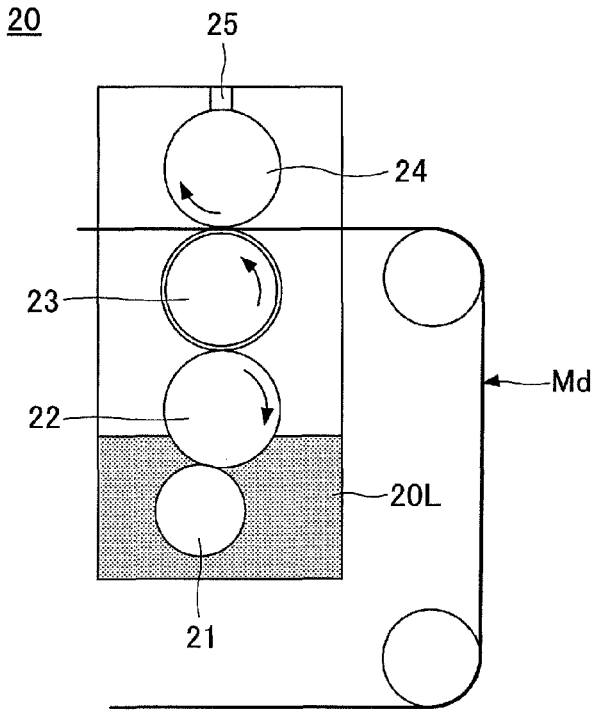
FIG. 2 is a schematic configuration diagram showing a pretreatment unit of the image formation apparatus of FIG. 1.

An example of the pretreatment unit 20 that uses a roll coating method is described with reference to FIG. 2. As shown in FIG. 2, the pretreatment unit 20 in the present embodiment coats the surface of the roll paper Md with a stored pretreatment liquid 20L, the roll paper Md being carried in (carried to) the pretreatment unit 20 by the carrying-in unit 10 (FIG. 1).

Specifically, the pretreatment unit 20 first transfers (moves) the pretreatment liquid 20L to a surface of a coating roller 23 in a film state by using a stirring (providing) roller 21 and a thinning (transport) roller 22. Next, the pretreatment unit 20 presses the coating roller 23 on a rotating platen roller 24 in order to rotate the coating roller 23. In this case, the pretreatment unit 20 can coat the surface of the roll paper Md with the pretreatment liquid 20L by carrying the roll paper Md between the coating roller 23 and the platen roller 24.

Further, the pretreatment unit 20 uses a pressure regulating device 25 to control a nip pressure (applied to a position where the coating roller 23 and the platen roller 24 are brought into contact) when the pretreatment liquid 20L is being applied. In addition or alternatively, the pretreatment unit 20 controls a rotational speed of the coating roller 23 and the platen roller 24. In accordance with this, the pretreatment unit 20 changes the rotational speed of the coating roller 23 and the like. In accordance with these features, the pretreatment unit 20 can control (change) a coating amount (such as film thickness, liquid amount, adhesion amount, or dry adhesion amount) of the pretreatment liquid 20L by changing the nip pressure using the pressure regulating device 25. Accordingly, the pretreatment unit 20 can coat the surface of the roll paper Md (recording medium) with the pretreatment liquid 20L while adjusting the coating amount to be suitable for image formation and post-treatment thereafter.

(Configuration of Drying Unit)

The drying unit 30 dries the recording medium by heating, for example. The drying unit 30 of the present embodiment includes a pretreatment drying unit 31 that dries the roll paper Md pretreated by the pretreatment unit 20 and a post-treatment drying unit 32 that dries the roll paper Md subjected to post-treatment by the post-treatment unit 50.

Figure 3:
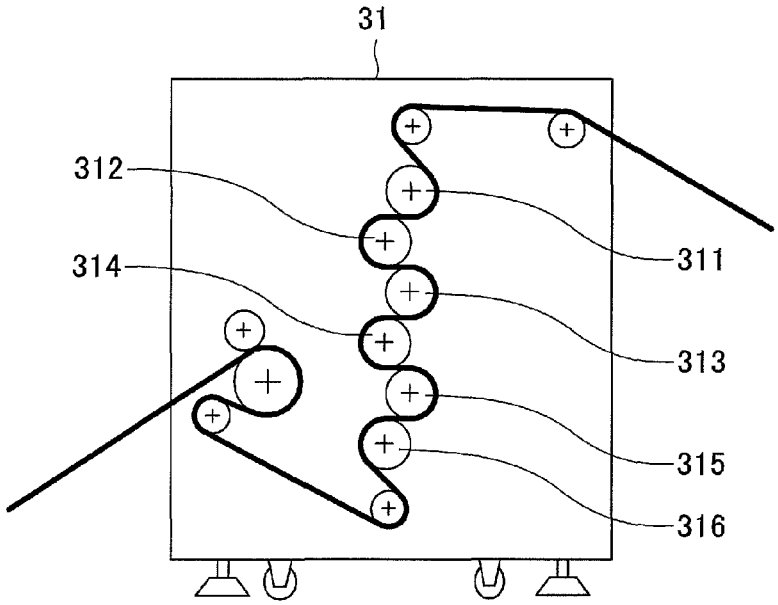
FIG. 3 is a schematic configuration diagram illustrating a drying unit of the image formation apparatus of FIG. 1.

The pretreatment drying unit 31 using heating rollers is described below. Heating rollers 311-316 are preferably disposed in multiple stages as shown in FIG. 3 in order to improve drying effects. In accordance with this, the pretreatment drying unit 31 uses the heating rollers 311-316 to heat the surface of the roll paper Md coated with the pretreatment liquid and vaporize moisture of the pretreatment liquid, thereby drying (the pretreatment liquid of) the roll paper Md. In this configuration, if drying intensity is to be lowered, a temperature of the heating rollers is lowered to be 40-80° C., for example. Further, only the heating rollers 311 and 312 are heated while the other heating rollers 313-316 are not heated. By contrast, it is possible to raise the drying intensity by increasing a number of heating rollers to be used or raising the temperature of the heating rollers.

While the drying intensity is controlled here in accordance with the temperature of the heating rollers and the number of the heating rollers to be used, the drying intensity can also be controlled by either of them. As mentioned above, it is possible to control the drying intensity using the temperature of the heating rollers and/or the number of the heating rollers to be used.

In addition, in the pretreatment drying unit 31, elements used for drying are not limited to heating rollers. In other words, the pretreatment drying unit 31 may employ infrared drying, microwave drying, hot-air drying, or other drying methods. Further, the pretreatment drying unit 31 may use a drying method in which a plurality of drying methods are combined. Further, the pretreatment drying unit 31 may heat the roll paper Md (recording medium) before the pretreatment unit 20 coats the roll paper Md with the pretreatment liquid (preheating step).

A configuration of the post-treatment drying unit 32 is the same as the configuration of the pretreatment drying unit 31, so that a description thereof is omitted.

(Configuration of Image Formation Unit)

The image formation unit 40 forms an image on a recording medium. The image formation unit 40 in the present embodiment forms an image on a surface of the roll paper Md by discharging droplets (hereafter "ink") onto the roll paper Md dried by the drying unit 30.

Figure 4A:
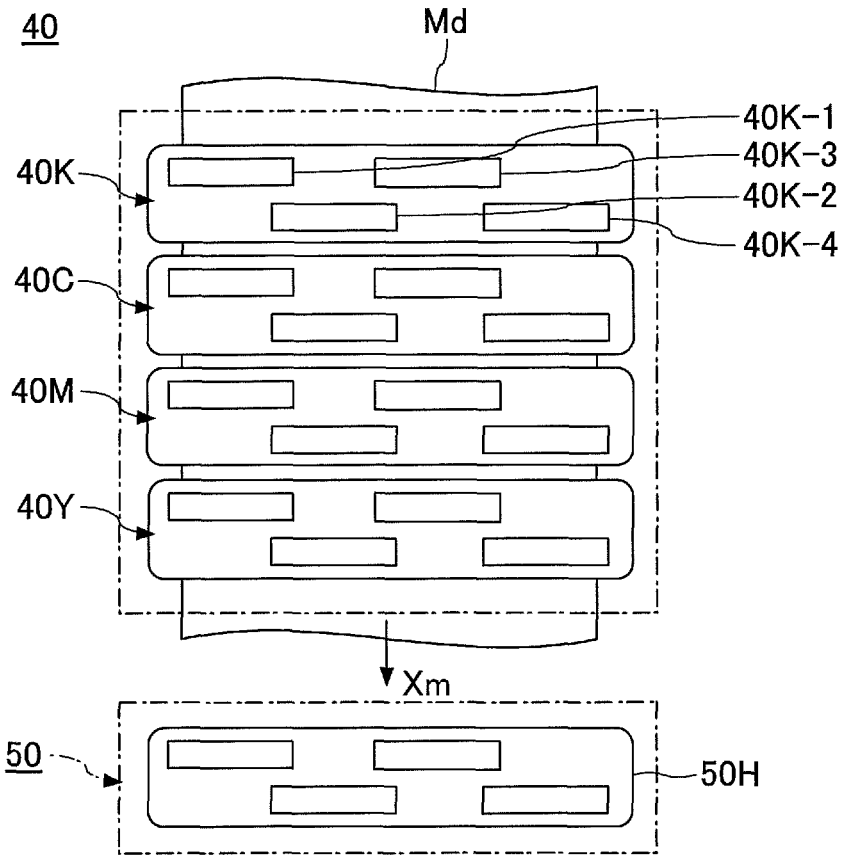
FIG. 4A is a diagram illustrating a line type head used for an image formation unit and a post-treatment liquid discharge unit of the image formation apparatus of FIG. 1.
Figure 4B:
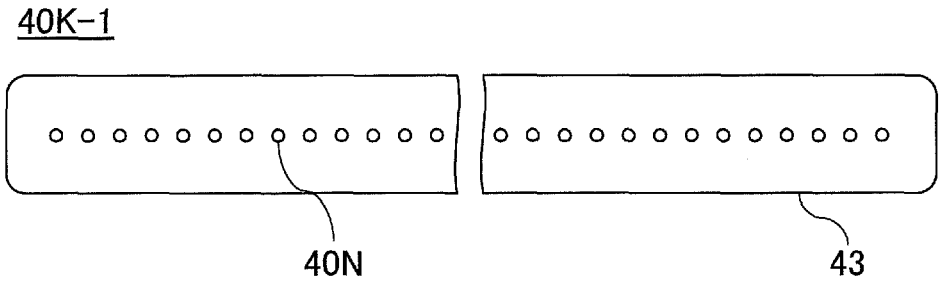
FIG. 4B is a partially enlarged view illustrating a line type head used for an image formation unit of the image formation apparatus of FIG. 1.

An example of an outer shape of the image formation unit 40 is described with reference to FIGS. 4A and 4B. FIG. 4A is a schematic plan view showing an entire configuration of the image formation unit 40 of the image formation apparatus 100 according to the embodiment of the present invention. FIG. 4B is a schematic plan view showing a main body (discharge head 40K for black (K)) of the image formation unit 40.

As shown in FIG. 4A, in the present embodiment, the image formation unit 40 may use a full-line type head. In other words, in the image formation unit 40, four discharge heads 40K, 40C, 40M, and 40Y for black (K), cyan (C), magenta (M), and yellow (Y) are disposed upstream in a carrying direction Xm of the recording medium.

In the present embodiment, the discharge head 40K for black (K) includes four head units 40K-1, 40K-2, 40K-3, and 40K-4 disposed in a staggered manner in a direction orthogonal to the carrying direction Xm of the roll paper Md. In accordance with this, the image formation unit 40 can form an image on an entire area in a width direction (orthogonal to the carrying direction Xm) of an image formation region (printing region) on the roll paper Md (recording medium). Since the recording medium is carried in the carrying direction Xm by the carrying belt 81, the discharge head 40K is moved relative to the recording medium (in a direction opposite to the carrying direction Xm of the recording medium). In addition, a configuration of the other discharge heads 40C, 40M, and 40Y is the same as the configuration of the discharge head 40K for black (K), so that a description thereof is omitted.

FIG. 4B is an enlarged view of the head unit 40K-1 of the discharge head 40K for black (K) of the image formation unit 40. As shown in FIG. 4B, the head unit 40K-1 in the present embodiment includes a plurality of discharge ports (nozzles, printing nozzles) 40N on a nozzle surface (outer surface of a nozzle plate 43 shown in FIG. 5A described below). The plurality of discharge ports 40N are arranged in line in a longitudinal direction of the head unit 40K-1 and constitute a nozzle line. The head unit 40K-1 may include a plurality of nozzle lines. While the discharge heads shown in FIG. 4A have two nozzle lines and two adjacent head units discharge droplets for one line, the head may have another shape. For example, a plurality of head units may be connected and arranged in line to constitute the head. Further, one head unit that has one nozzle line extending in the width direction of the recording medium for one line may constitute one head.

These discharge heads 40K, 40C, 40M, and 40Y installed on a carriage 46 (see FIG. 7) serve as a first discharge unit that discharges ink (color droplets).

Figure 5A:
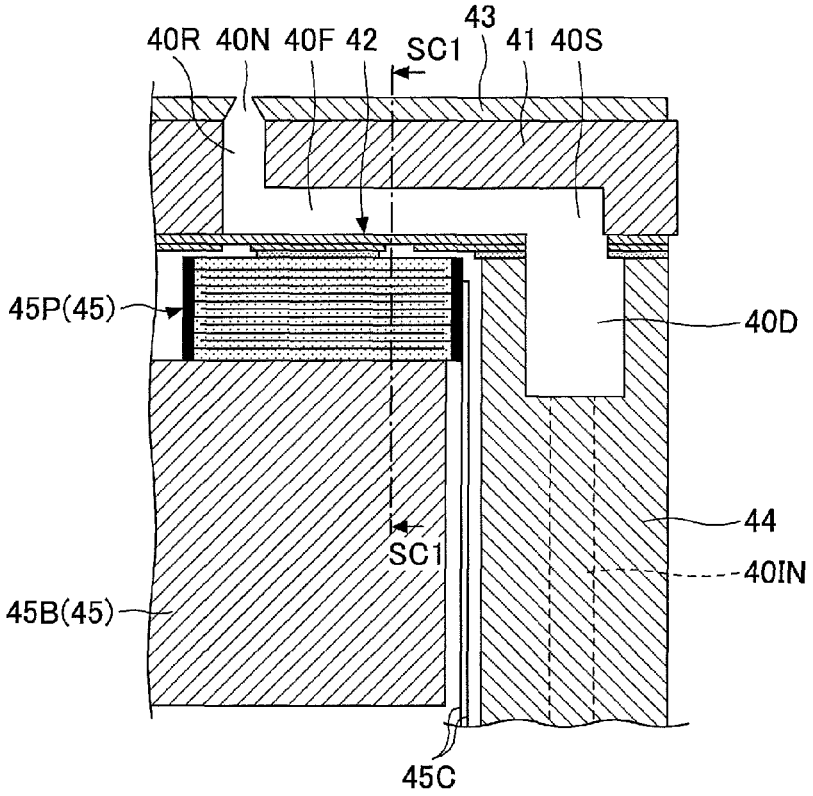
FIG. 5A is a schematic cross-sectional view illustrating an image formation unit and a post-treatment liquid discharge unit of an image formation apparatus according to an embodiment of the present invention.
Figure 5B:
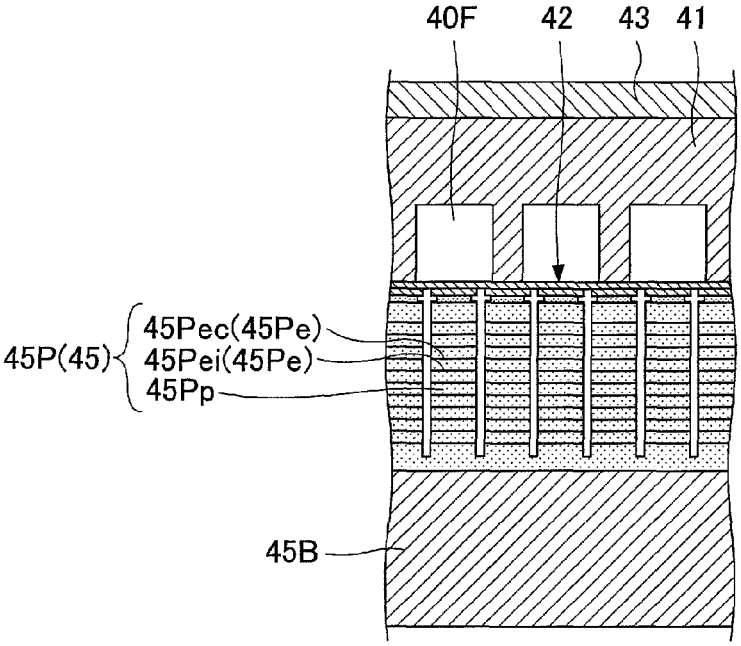
FIG. 5B is a schematic cross-sectional view illustrating an image formation unit and a post-treatment liquid discharge unit of an image formation apparatus according to an embodiment of the present invention.

A cross-sectional shape of the discharge head of the image formation unit 40 is described with reference to FIGS. 5A and 5B. FIG. 5A is a schematic cross-sectional view illustrating a flow channel (cross section in a longitudinal direction of a liquid chamber 40F) of the image formation unit 40. FIG. 5B is a cross-sectional view illustrating arrangement of the discharge ports 40N of the image formation unit 40 (cross section (taken along line SC1-SC1 in FIG. 5A) in a lateral direction of the liquid chambers 40F (direction where the discharge ports are arranged)).

As shown in FIG. 5A, the discharge head (40K, for example) of the image formation unit 40 according to the embodiment of the present invention includes a flow channel plate 41 that forms a passage of ink to be discharged, a vibration plate 42 joined to an undersurface (inner direction of the discharge head) of the flow channel plate 41, the nozzle plate 43 joined to an upper surface (outer direction of the discharge head) of the flow channel plate 41, and a frame member 44 that holds a peripheral part of the vibration plate 42. Further, the discharge head also includes a pressure generation unit (actuator unit) 45 that deforms the vibration plate 42.

Since the flow channel plate 41, the vibration plate 42, and the nozzle plate 43 are piled up, the discharge head (40K, for example) according to the present embodiment can form the liquid chamber 40F and a nozzle communication channel 40R that is in communication with the discharge port (nozzle) 40N. Further, since the frame member 44 is further piled up, the discharge head can form an ink inflow port 40S to supply the liquid chamber 40F with ink and a common liquid chamber 40D to supply the liquid chamber 40F with ink.

Further, the discharge head can deform (deflective deformation) the vibration plate 42 by using the pressure generation unit 45. In accordance with this, the discharge head can change capacity (volume) of the liquid chamber 40F and change pressure applied to ink within the liquid chamber 40F. As a result of this, the discharge head can discharge the ink from the discharge ports 40N.

In the present embodiment, in the frame member 44, a housing portion where the pressure generation unit 45 is housed, a concave part that serves as the common liquid chamber 40D, and an ink supply port 401N to supply the common liquid chamber 40D with ink from the outside of the discharge head are formed.

The pressure generation unit 45 may employ an electromechanical conversion element. The pressure generation unit 45 in the present embodiment includes a piezoelectric element 45P that serves as the electromechanical conversion element, a base substrate 45B that joins and fixes the piezoelectric element 45P, and a support disposed in a space between adjacent piezoelectric elements 45P. Further, the pressure generation unit 45 includes an FPC cable 45C, for example, to connect the piezoelectric element 45P to a driving circuit (driving IC) (not shown).

The piezoelectric element 45P may employ a laminated piezoelectric element (PZT) as shown in FIG. 5B in which a piezoelectric material 45Pp and an internal electrode 45Pe are alternately laminated. The internal electrode 45Pe includes a plurality of individual electrodes 45Pei and a plurality of common electrodes 45Pec. In the present embodiment, the individual electrode 45Pei and the common electrode 45Pec are alternatively connected to an end surface of the piezoelectric material 45Pp. Further, the piezoelectric element 45P uses d33 direction as a piezoelectric direction of the piezoelectric element 45P. In accordance with this, the pressure generation unit 45 can pressurize or depressurize ink within the liquid chamber 40F by using piezoelectric effects (displacement in the d33 direction) of the piezoelectric element 45P. The pressure generation unit 45 may pressurize or depressurize the ink within the liquid chamber 40F by using displacement in d31 direction of the piezoelectric element 45P. Further, in the pressure generation unit 45, a line of piezoelectric elements may be disposed for one discharge port 40N. In addition, the support may be formed together with the piezoelectric element 45P when a piezoelectric element member (piezoelectric element 45P) is divided. In other words, the discharge head can use the piezoelectric element member as the support by not applying voltage to the piezoelectric element 45P.

The pressure generation unit 45 used in the present embodiment is not limited to the above-mentioned example (piezoelectric element 45P). In other words, the pressure generation unit 45 may employ a method (what is called a thermal type) for generating bubbles by heating the ink within the liquid chamber 40F using a heating element (see Japanese Laid-Open Patent Application No. 61-59911, for example).

Further, the pressure generation unit 45 may employ a method (what is called an electrostatic type) by which a vibration plate and an electrode are disposed on wall surfaces of the liquid chamber 40F to face each other, and the vibration plate is deformed by electrostatic force generated between the vibration plate and the electrode (see Japanese Laid-Open Patent Application No. 6-71882, for example).

(Configuration of Post-Treatment Unit)

The post-treatment unit 50 performs post-treatment on the recording medium on which an image has been formed. The post-treatment unit 50 uses a post-treatment liquid to perform the post-treatment on a surface of the roll paper Md on which the image has been formed by the image formation unit 40.

Figure 6A:
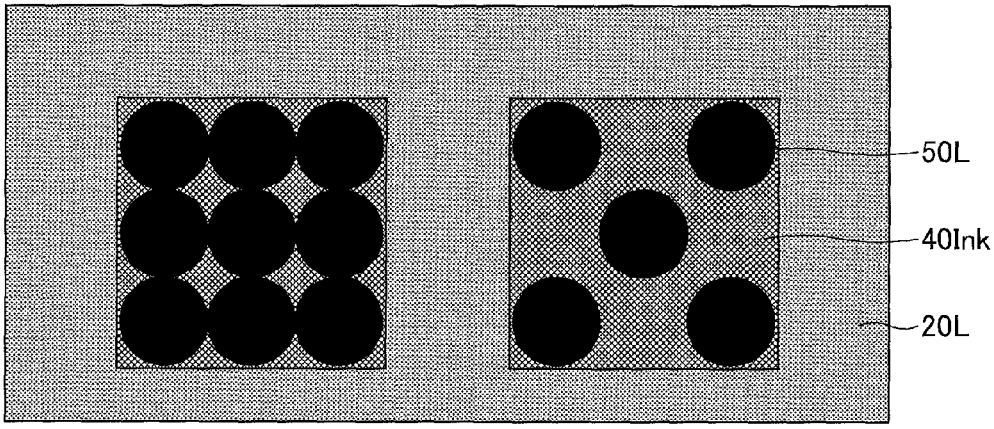
FIG. 6A is a top view illustrating a recording medium when an image formation apparatus according to an embodiment of the present invention has formed an image.
Figure 6B:
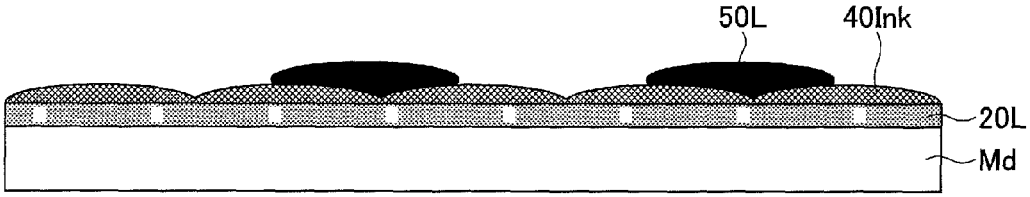
FIG. 6B is cross-sectional view illustrating a recording medium when an image formation apparatus according to an embodiment of the present invention has formed an image.

The post-treatment refers to treatment to discharge (deposit) a post-treatment liquid 50L (described later) onto the roll paper Md (recording medium). The post-treatment liquid 50L is applied in spots or in stripes, for example. In accordance with this, it is possible to improve abrasion resistance, glossiness, and preservation stability (such as water resistance, light resistance, and gas resistance) of the recording medium on which the image is formed. As shown in FIGS. 6A and 6B, for example, when the post-treatment by the post-treatment unit 50 starts, the surface of the roll paper Md has already been coated with the pretreatment liquid 20L and ink 40Ink that forms the image has been further discharged thereon. The post-treatment unit 50 of the image formation apparatus 100 according to the embodiment of the present invention performs the post-treatment to discharge (deposit) the post-treatment liquid 50L onto the roll paper Md on which the image has been formed.

FIG. 6B is a schematic diagram illustrating a predetermined cross section of the recording medium. The post-treatment liquid 50L is discharged (deposited) in an area smaller than at least an area of the pretreatment liquid 20L. Further, in this cross section, the ink 40Ink is discharged onto an entire area and the post-treatment liquid 50L is discharged (deposited) in the area smaller than an area of the ink 40Ink.

While the post-treatment liquid 50L seems to be formed in spots in FIG. 6B, the post-treatment liquid 50L may be formed in stripes in a direction orthogonal to the cross section.

The post-treatment liquid 50L may be discharged (deposited) in a portion where the image is formed on the recording medium, in an area smaller than a surface area where the image is formed. The post-treatment liquid 50L may or may not be discharged in a portion where the image is not formed.

As a post-treatment method, the post-treatment liquid 50L is preferably deposited (discharged) onto only a specified portion in a field of the roll paper Md where the image is formed. Further preferably, the post-treatment unit 50 changes a discharging amount (coating amount) and a discharging (coating) method of the post-treatment liquid 50L based on a type, permeability, glossiness, and/or resolution of the recording medium, and/or a coating amount (liquid amount) of the pretreatment liquid 20L coated by the pretreatment unit 20.

Further, the post-treatment unit 50 according to the present embodiment can discharge the post-treatment liquid 50L in any region (any location) with a desired discharging amount (in desired spots or desired stripes) using the same discharge head as in the image formation unit 40 shown in FIGS. 4A and 4B.

Specifically, the post-treatment unit 50 can select (1) discharging in an entire field of an area of the roll paper Md where an image can be formed; (2) discharging in a field where the image is formed; (3) discharging only in a field of an image formation portion (where dots are discharged); or (4) discharging in a field larger than the image formation portion of the roll paper Md (recording medium), the field being larger than an outer edge of the image formation portion by 1 or more dots, for example. Further, the post-treatment unit 50 can discharge the post-treatment liquid 50L in an no field (in spots or in stripes) relative to a selected field where the post-treatment liquid 50L is to be discharged. In this case, no may be set to 5-50%. Further, n % may be predetermined through experiments, numerical calculation, or the like.

Further, the post-treatment unit 50 according to the present embodiment can select, as a method for discharging the post-treatment liquid 50L, (1) discharging based on a printing duty or (2) discharging based on a droplet amount of the post-treatment liquid 50L to be discharged, for example. In this case, the post-treatment unit 50 may calculate the printing duty and the droplet amount of the post-treatment liquid 50L from input information (print image data, for example) and determine the method for discharging based on a calculated printing duty or the like.

Thus, according to the image formation apparatus 100 in the embodiment of the present invention, it is possible to use the post-treatment unit 50 to deposit (discharge) the post-treatment liquid 50L only in a specified portion in a field where an image is formed in comparison with a case where the post-treatment liquid 50L is coated (discharged) onto an entire area of the recording medium. Thus, according to the image formation apparatus 100 in the present embodiment, it is possible to reduce time required for post-treatment or time required for drying the post-treatment liquid 50L in particular. Further, it is possible to reduce a liquid amount of the post-treatment liquid 50L required for post-treatment. Thus, it is possible to reduce cost required for the post-treatment.

In addition, the post-treatment method performed by the post-treatment unit 50 is not especially limited, so that another post-treatment method may be selected where necessary depending on a type of the post-treatment liquid 50L. The post-treatment method performed by the post-treatment unit 50 preferably employs the same method as used for discharging ink of the image formation unit 40 in terms of size reduction of an apparatus and preservation stability of the post-treatment liquid 50L. Accordingly, a configuration of the post-treatment unit 50 is determined in the same manner with reference to FIG. 4A. A post-treatment liquid discharge unit includes a plurality of discharge ports (nozzles, printing nozzles) 50N on a nozzle surface (outer surface of a nozzle plate 53 shown in FIG. 5A). A head 50 that serves as the post-treatment liquid discharge unit including the nozzle plate 53 is installed on a carriage 56 (see FIG. 7) and the head 50 serves as a second discharge unit that discharges the post-treatment liquid 50L (transparent droplets).

When the post-treatment liquid 50L is to be discharged, a suitable amount of a water-soluble organic solvent (wetting agent) used in a method for discharging ink of the image formation unit 40 is preferably contained. Further, in the post-treatment unit 50 according to the present embodiment, a dry adhesion amount of the post-treatment liquid 50L is preferably 0.5 $g/m^2$ to 10 $g/m^2$.

The post-treatment unit 50 according to the present embodiment may use, as the post-treatment liquid 50L, a treatment liquid that contains a component that can form a transparent protective layer on the roll paper Md (recording medium). Examples of such a treatment liquid that contains a component that can form a transparent protective layer include a treatment liquid that contains water-dispersible resin (resin), water-soluble organic solvent (wetting agent), penetrant, surface-active agent, water, and/or other components where necessary. Further, the post-treatment liquid 50L may be a resin composition that contains a component that polymerizes under ultraviolet irradiation and/or thermoplastic resin. Further, the post-treatment liquid 50L preferably includes a thermoplastic resin emulsion in order to improve glossiness and a fixing property. In accordance with this, the post-treatment unit 50 can increase the glossiness of a surface of the roll paper Md on which an image is formed or protect the surface of the roll paper Md with a resin layer depending on a discharging (coating) method.

By using such a post-treatment apparatus, it is possible to prevent detachment (removal) of an image (ink) on the recording medium when the surface of the roll paper Md on which the image is formed rubs against another object (another recording medium, for example). In other words, it is possible to improve abrasion resistance (friction resistance). Further, it is possible to reduce generation of a quality problem in an image to be formed involving blur, density, color tone, glossiness, and set-off and to reduce generation of a problem related to water resistance, weatherability, and image fastness.

(Maintenance and Recovery Unit)

Figure 7:
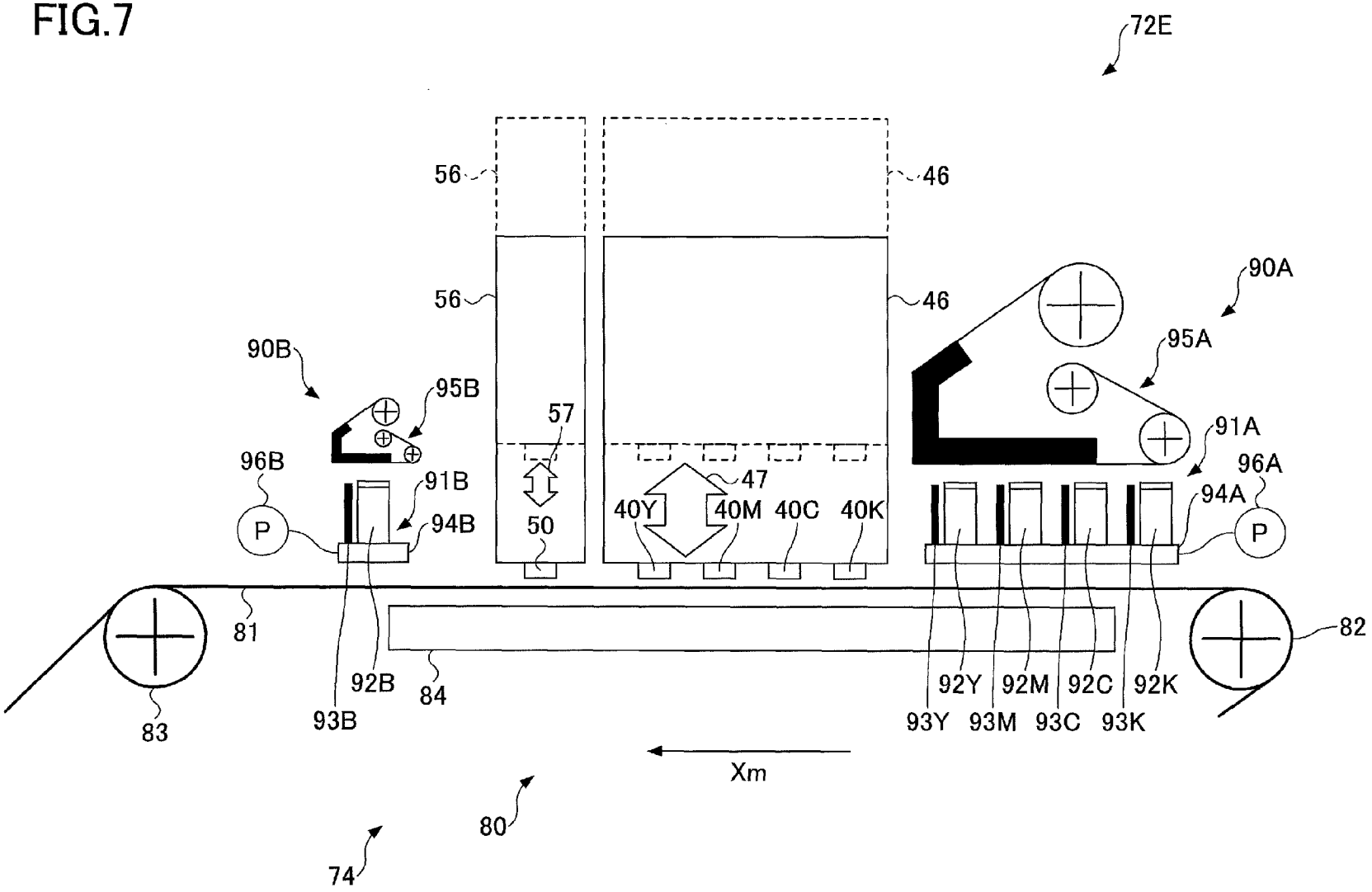
FIG. 7 is an illustration of an image formation unit and a post-treatment liquid discharge unit according to an embodiment of the present invention.
Figure 8:
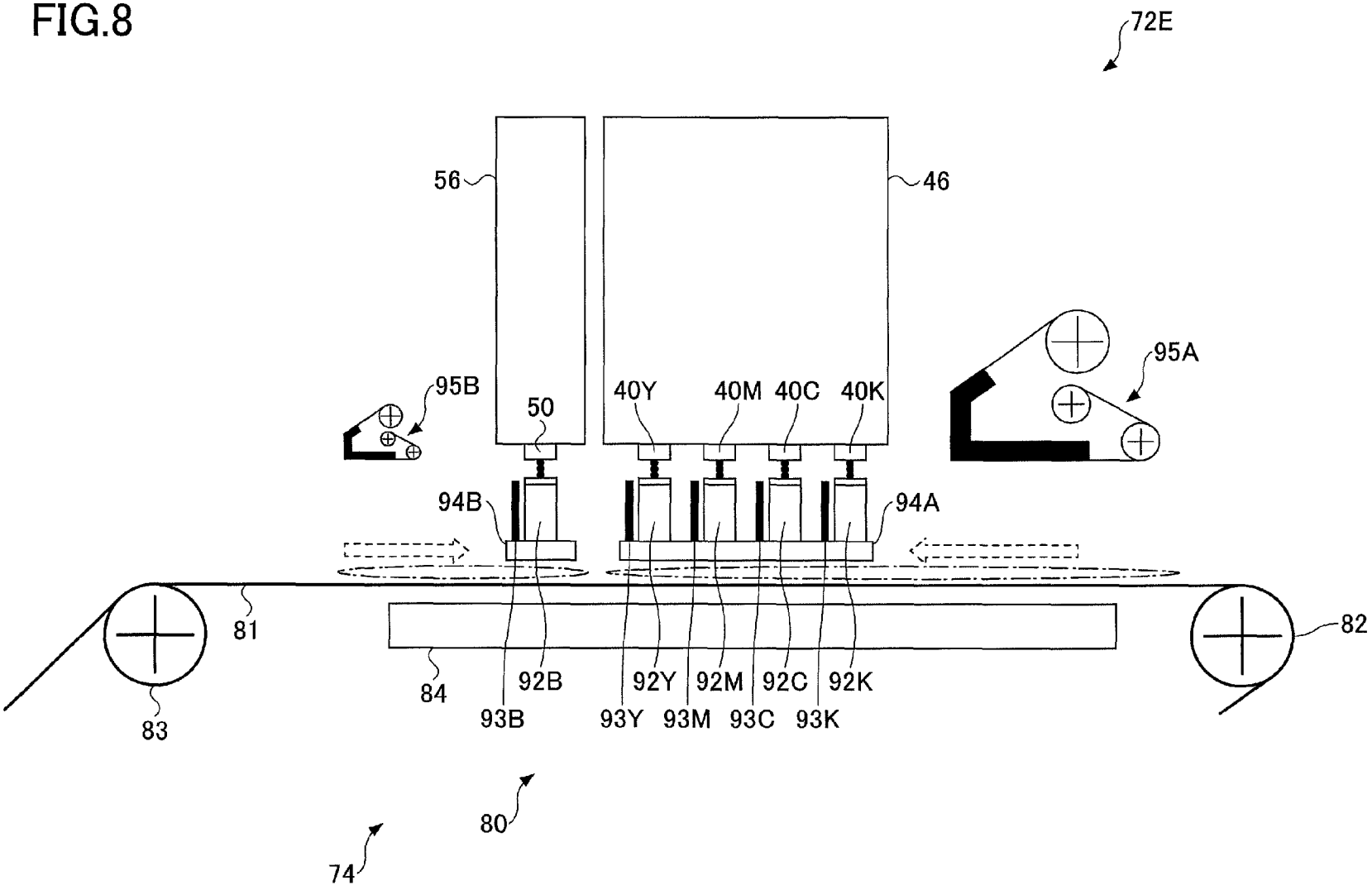
FIG. 8 is an illustration of a maintenance and recovery operation for an image formation unit and a post-treatment liquid discharge unit according to an embodiment of the present invention.
Figure 9:
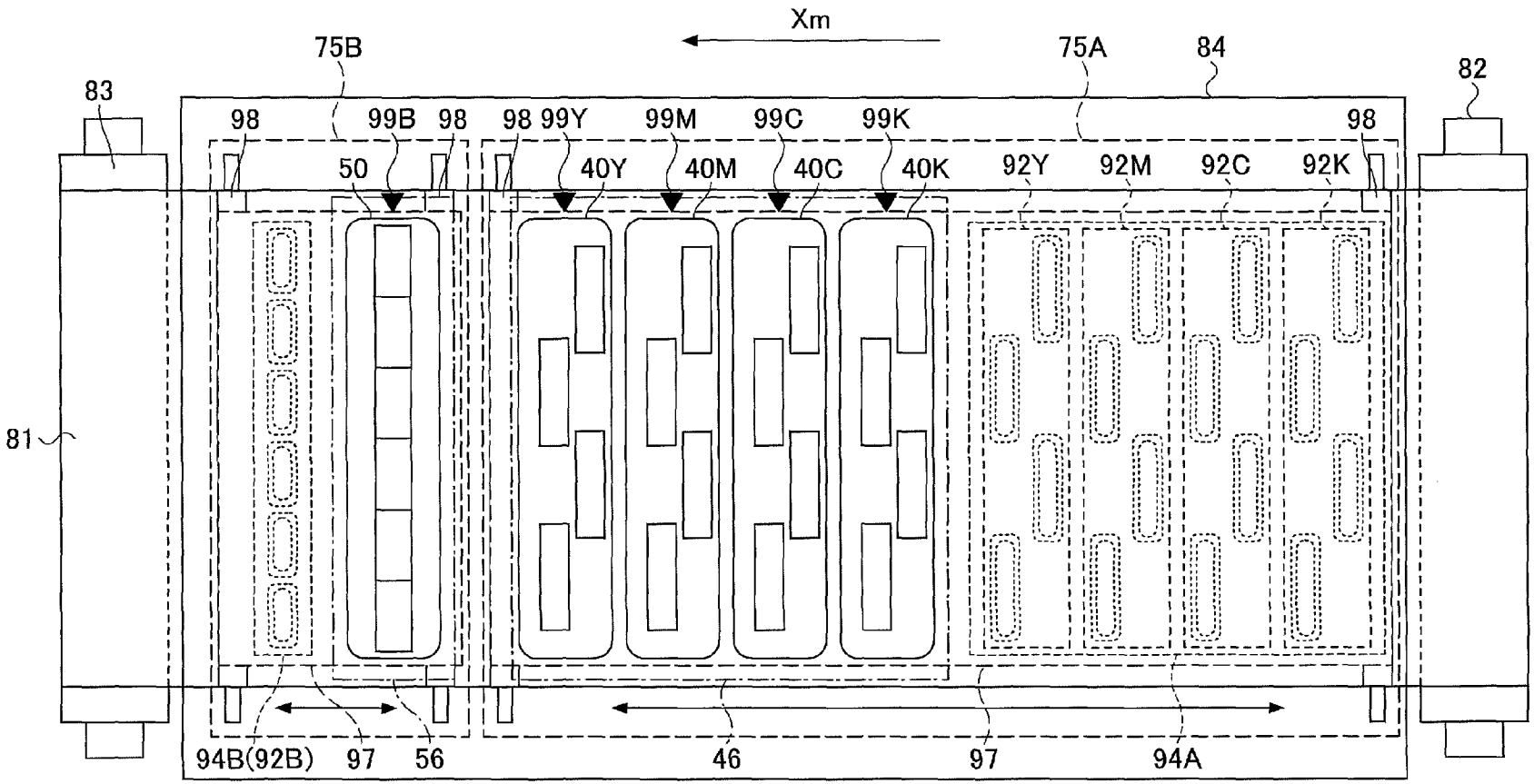
FIG. 9 is a plan view of an image formation unit, a post-treatment liquid discharge unit, and a maintenance and recovery unit according to an embodiment of the present invention.

The maintenance and recovery units 90A and 90B maintain and recover (restore performance of) the image formation unit 40 and the post-treatment unit 50. When the image formation unit 40 and the post-treatment unit 50 that employ the above-mentioned head (see FIG. 4A) are used for a long period of time, the head may be clogged with the ink or the post-treatment liquid. Accordingly, it is desirable to perform a maintenance and recovery operation (cleaning and maintenance) when not performing printing such as before printing. FIGS. 7-9 show the maintenance and recovery units 90A and 90B in which a line type head is used for the image formation unit 40 and the post-treatment unit 50.

FIG. 7 is a schematic diagram illustrating a discharge head, a post-treatment liquid output unit, and a maintenance and recovery unit in the embodiment of the present invention. In FIG. 7, the image formation unit (ink head) 40 and the post-treatment unit (post-treatment liquid output unit, head) 50 are disposed so as to face the carrying belt 81 serving as a carrying unit. The carrying belt 81 carries the recording medium in the carrying direction Xm shown by an arrow. The maintenance and recovery unit 90A (maintenance unit) is disposed upstream (right side in FIG. 7) relative to the image formation unit 40 and the maintenance and recovery unit 90B (maintenance unit) is disposed downstream (left side in FIG. 7) relative to the post-treatment unit 50 in the carrying direction Xm of the recording medium. The maintenance and recovery units 90A and 90B maintain and recover the image formation unit 40 and the post-treatment unit 50 each including a line type head.

The heads of the image formation unit 40 and the post-treatment unit 50 are configured to be vertically movable. The discharge heads 40K, 40C, 40M and 40Y (first discharge unit) for four colors serving as the image formation unit are disposed on the carriage 46 and the head 50 (second discharge unit) that discharges the post-treatment liquid 50L is disposed on the carriage 56.

The carriages 46 and 56 can move between a position close to the carrying unit 80 shown in FIG. 7, namely, a recording position which is a printing position to discharge a liquid (ink, post-treatment liquid) and a spaced position which is a position spaced apart from the carrying unit 80 as shown in FIG. 8. This spaced position functions as a maintenance position to maintain the image formation unit 40 and the post-treatment unit 50 by the maintenance and recovery units 90A and 90B. The spaced position also functions as a standby position to wait for a next operation and as a recovery position to perform maintenance.

In order to perform this vertical movement, the carriages 46 and 56 are respectively supported by carriage position movement units 47 and 57. When the carriage position movement units 47 and 57 are operated, positions of the carriages 46 and 56 are vertically moved relative to the case 74 of the printer engine 72E having the carrying belt 81. In addition, while the carriage position movement units 47 and 57 are indicated by arrows in FIG. 7, a movement mechanism including a rail and a roller used in combination may be employed for the carriage position movement units 47 and 57 or an arm or the like may be used to lift the carriage position movement units 47 and 57.

In the carrying unit 80, the carrying belt 81 is stretched and installed for rotational movement between a driving roller 83 rotated by a motor and a driven roller 82. The recording medium is carried in accordance with the rotational movement of the carrying belt 81 supported by a supporting member 84. The supporting member 84 may include a suction unit or an electrostatic attraction unit in order to attract paper while carrying the paper.

Further, the maintenance and recovery unit 90A includes an engagement unit 91A and a cleaning unit 95A. The maintenance and recovery unit 90B includes an engagement unit 91B and a cleaning unit 95B.

When maintenance is performed, the engagement unit 91A is reciprocated to an opposite field that faces the discharge heads 40K, 40C, 40M and 40Y serving as the image formation unit 40 in the spaced position (dotted line in FIG. 7) and the engagement unit 91A is selectively engaged with the discharge heads 40K, 40C, 40M and 40Y. When maintenance is performed, the engagement unit 91B is reciprocated to an opposite field that faces the head 50 serving as the post-treatment unit 50 in the spaced position (dotted line in FIG. 7) and the engagement unit 91B is engaged with the head 50.

Since the maintenance and recovery units 90A and 90B have the same configuration except a number of cap units and liquid to be received (ink, post-treatment liquid), the same configuration is described with reference to the maintenance and recovery unit 90B of the post-treatment unit 50 to be controlled in the present embodiment and a description of the same configuration of the maintenance and recovery unit 90A is omitted. Further, for elements used in common in the maintenance and recovery units 90A and 90B, reference numerals added to ends thereof are omitted.

The engagement unit 91 includes a cap unit 92, a wiper 93, and a fixing member 94 that fixes the cap unit 92 and the wiper 93. The cap unit 92 engages the head 50 in the spaced position in order to seal and cap the nozzles 50N of the head 50. When the maintenance is performed, the head 50 performs what is called an idle discharge to discharge the post-treatment liquid 50L while the cap unit 92 is engaged. The cap unit 92 functions as an idle discharge receiver that receives the post-treatment liquid 50L discharged from the head 50 by the idle discharge. The wiper 93 performs cleaning (wiping) on the head 50 by wiping off the post-treatment liquid 50L flowing from the head 50 in the spaced position.

A cleaning unit 95 performs cleaning on the cap unit 92, the wiper 93, and the like while the engagement unit 91 is in a home position thereof after the engagement unit 91 is reciprocated when the maintenance is performed. In addition, the cleaning of the engagement unit 91 by the cleaning unit 95 may be regularly performed after a predetermined number of images are formed, for example.

The maintenance and recovery unit 90 also includes a pump 96 serving as a suction unit that suctions the post-treatment liquid 50L inside the head 50 and drains the post-treatment liquid 50L to the outside of the head 50 while the cap unit 92 is engaged with the head 50 in the spaced position. The maintenance and recovery unit 90 further includes a drain passage that connects the cap unit 92 to the pump 96 and drains the post-treatment liquid 50L to the outside of the head 50 and a fluid collection unit connected to the drain passage, the fluid collection unit collecting liquids (ink, post-treatment liquid) draining to the outside of the head 50.

FIG. 9 is a plan view of FIG. 7. As shown in FIG. 9, the maintenance and recovery unit 90A includes cap units 92K, 92C, 92M, and 92Y for each head segment serving as the image formation unit 40 in a direction orthogonal to the carrying direction Xm of the recording medium, and the maintenance and recovery unit 90B includes a cap unit 92B.

Further, the maintenance and recovery unit 90 includes a movement unit that moves the engagement unit 91. As the movement unit of the engagement unit 91, the maintenance and recovery unit 90 includes a reciprocation unit (97, 98, 99) that reciprocates the engagement unit 91 to the heads 40, 50 and a vertical movement unit (75) that supports the reciprocation unit and moves the cap unit 92 vertically, the vertical movement unit (75) being integrated with the engagement unit 91.

The reciprocation unit includes the fixing member 94 integrated with the engagement unit 91, an endless belt 97 whose portion fixes the fixing member 94, and two pulleys 98 on which the endless belt 97 is wound. The reciprocation unit further includes a position sensor 99 (99K, 99C, 99M, 99Y, and 99B) that detects being positioned directly below the head 40 or 50 and being positioned in the home position (where reciprocation starts). The reciprocation unit further includes a support table that supports the engagement unit 91 from below reciprocatively as mentioned above and a motor or the like that rotates the pulley 98 as a driving unit.

Further, the vertical movement unit 75 includes base members 75A and 75B on which the support table including the endless belt 97 is placed, the base members 75A and 75B being arranged and fixed below from above the case 74 across a paper movement space. A bottom face of these base members 75A and 75B is screwed with a shaft serving as a driving shaft and connected to a plurality of gears fixed on the other end of the shaft, the plurality of gears being rotated together with the shaft. The plurality of gears are connected to a stepping motor that rotates the gears.

Accordingly, it is possible to reciprocate the engagement unit 91 by driving the motor to rotate the pulley 98 for rotation movement of the endless belt 97 as the reciprocation unit. In this case, by driving the motor such that any one of the position sensors 99 detects the fixing member 94, it is possible to position the cap units 92K, 92C, 92M, and 92Y or the cap unit 92B to face the discharge heads 40K, 40C, 40M, and 40Y or the head 50 in the spaced position or to position the cap units 92K, 92C, 92M, and 92Y or the cap unit 92B in the home position with precision.

Further, while the cap units 92K, 92C, 92M, 92Y, and 92B are positioned to face the discharge heads 40K, 40C, 40M, 40Y, and the head 50 by the position sensor 99, by driving the stepping motor a predetermined amount, namely, a predetermined number of pulses, the base members 75A and 75B are moved upward. In accordance with this, it is possible to move the engagement units 91A and 91B upward by a predetermined amount and engage them with the discharge heads 40K, 40C, 40M and 40Y or the head 50 in the spaced position the cap units 92K, 92C, 92M, 92Y, and 92B face. In addition, instead of using the stepping motor, a sensor that detects a position of the cap unit 92 in the vertical direction may be used in combination with a motor.

When such a configuration is used to perform a maintenance and recovery operation, as shown in FIG. 8, the image formation unit 40 and the post-treatment unit 50 are moved upward to be in the spaced position while the engagement units 91A and 91B of the maintenance and recovery units 90A and 90B are stopped directly below each head in the spaced position and are engaged.

In the embodiment of the present invention, before the maintenance and recovery operation is performed, test patterns to be described below are formed and a user, an administrator, or a service person confirms the test patterns printed on the recording medium by visual observation. Further, a maintenance and recovery operation described below is performed only if maintenance (cleaning, for example) is determined to be necessary by visual observation. Further, maintenance is performed only on a head segment that requires such maintenance depending on a result of the visual observation of the test patterns.

Specifically, depending on the result of the visual observation of the test patterns, the maintenance and recovery operation is performed only on the cap unit 92K, 92C, 92M, 92Y, or 92B that requires maintenance. Further, in each cap unit such as the cap unit 92B for post-treatment, the maintenance and recovery operation can be performed only on a portion for a specific nozzle (50N) within a corresponding head segment.

In the maintenance and recovery operation, the nozzles 40N and 50N of the heads in the image formation unit 40 and the post-treatment unit 50 are capped with the cap unit 92 for idle charge reception. Ink and post-treatment liquid within the heads are suctioned by the pump 96 from the discharge ports 40N and the nozzles 50N via the cap unit 92.

When nozzle suction is complete as the maintenance and recovery operation, after the engagement units 91A and 91B are returned to the home position, the image formation unit 40 and the post-treatment unit 50 move downward to a printing position on the carrying unit 80 and assume a printable state.

In the embodiment described with reference to FIGS. 7-9, the discharge heads 40K, 40C, 40M and 40Y serving as the image formation unit and the head 50 serving as the post-treatment unit are installed on the carriages 46 and 56 that are independent of each other. In accordance with this, it is possible to maintain the image formation unit and the post-treatment unit at different times.

However, the image formation unit 40 and the post-treatment unit 50 may be integrally configured and installed on the same carriage. In such a configuration, the maintenance and recovery units 90A and 90B are also integrally configured, so that the movement mechanism is simplified and the cap units 92K, 92C, 92M, 92Y, and 92B are also simplified. In this case, the integrally configured engagement unit 91 collectively caps the discharge heads 40K, 40C, 40M and 40Y and the head 50 and performs a maintenance and recovery operation. Accordingly, it is possible to collectively dispose the maintenance and recovery units upstream or downstream relative to the image formation unit 40 or the post-treatment unit 50 in the carrying direction Xm of the roll paper Md.

(Configuration of Carrying-Out Unit)

The carrying-out unit 60 carries out (ejects) a recording medium on which an image or the like is formed. As shown in FIG. 1, the carrying-out unit 60 in the present embodiment is configured with a storage unit 61 and a plurality of carrying rollers 62. The carrying-out unit 60 uses the carrying rollers 62 to roll up and store the roll paper Md having the image thereon on a storage roller of the storage unit 61.

If pressure applied to the roll paper Md is great when the roll paper Md is rolled on the storage roller of the storage unit 61, a drying device that further dries the roll paper Md immediately before the roll paper Md is rolled up may be disposed in order to prevent transfer of another image to a rear surface of the roll paper Md.

(Configuration of Control Unit)

The control unit 70 controls operations of the image formation apparatus 100. The control unit 70 in the present embodiment sends an instruction to each element of the image formation apparatus 100 to perform an operation and controls the operation. The control unit 70 according to the present embodiment is described with reference to FIGS. 10A-13.

In addition, the image formation apparatus 100 according to the embodiment of the present invention may employ production printing as a printing system. The production printing here refers to a production system capable of printing (image formation, character printing) on a huge amount of printed matter (image forming medium, character printed matter) in a short time by efficiently performing job management and print data management, for example. Specifically, the image formation apparatus 100 according to the present embodiment performs, with different devices (units), a Raster Image Processor (RIP) process to control an operation to print bitmap data or the like and a print process based on the bitmap data controlled by the RIP process.

Further, the image formation apparatus 100 (control unit 70) according to the present embodiment has a workflow system that manages from creation of print data to distribution of printed matter. In other words, the image formation apparatus 100 (control unit 70) according to the present embodiment is capable of accelerating printing by separating a device that performs the RIP process that requires processing time from a device that performs the print process.

Figure 10A:
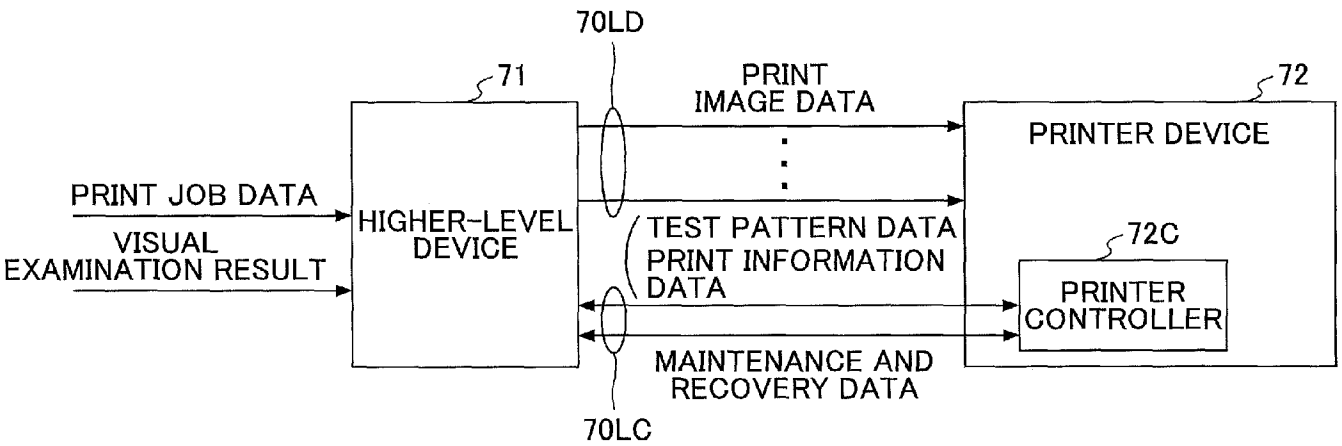
FIG. 10A is a schematic configuration diagram illustrating a control unit of an image formation apparatus according to an embodiment of the present invention.
Figure 10B:
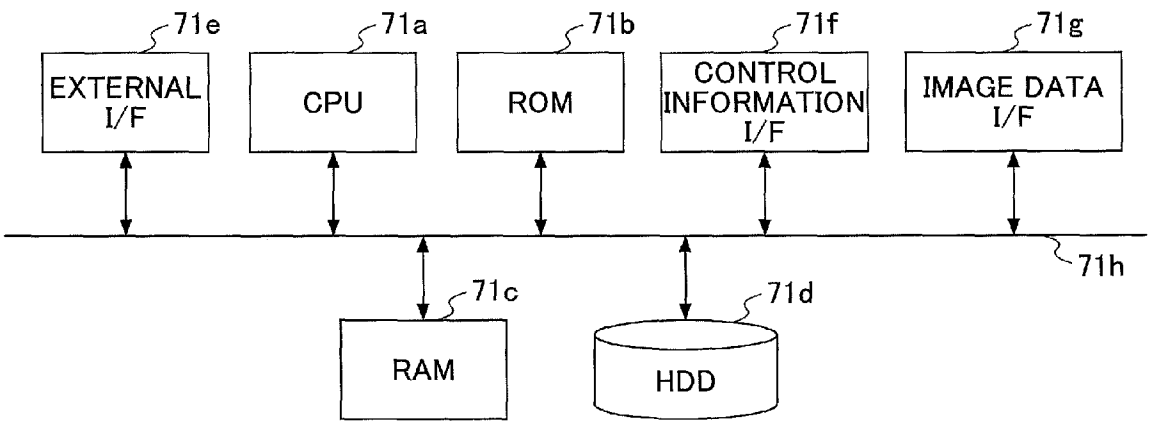
FIG. 10B is a schematic configuration diagram illustrating a control unit of an image formation apparatus according to an embodiment of the present invention.

As shown in FIG. 10A, the control unit 70 of the image formation apparatus 100 according to the embodiment of the present invention includes a higher-level device (DFE: Digital Front End) 71 that performs the RIP process and a printer device 72 that performs the print process. The higher-level device 71 and the printer device 72 here are connected to each other via a plurality of data lines 70LD and a control line 70LC.

In the following, the higher-level device 71 and the printer device 72 according to the present embodiment are described in detail.

(Higher-Level Device)

The higher-level device 71 of the control unit 70 in the image formation apparatus 100 according to the embodiment of the present invention performs the RIP process based on print job data (job data, print data) output from a host device. In other words, the higher-level device 71 according to the present embodiment creates sets of bitmap data (hereafter "print image data") one set being created for each color based on the print job data. The print image data in the present embodiment further includes data about discharge of a post-treatment liquid to be discharged by the post-treatment unit 50 (hereafter "image data about post-treatment").

Further, the higher-level device 71 according to the present embodiment creates data to control a print operation (hereafter "control information data") based on the print job data and information about the host device. The control information data here includes data about print conditions (print form, print type, paper feed or ejection information, order of printing surfaces, size of printing paper, data size of print image data, resolution, paper type information, tones, color information, and a number of pages to be printed). Further, the control information data in the present embodiment further includes data about discharge of a post-treatment liquid to be discharged by the post-treatment unit 50 (hereafter "control data about post-treatment").

Further, when maintenance and recovery is performed, a user, an administrator, or a serviceman inputs information detected by visual observation to the higher-level device 71.

As shown in 10B, the higher-level device 71 in the present embodiment includes a Central Processing Unit (CPU) 71*a*, a Read Only Memory (ROM) 71*b*, Random Access Memory (RAM) 71*c*, and a Hard Disk Drive (HDD) 71*d*. Further, the higher-level device 71 includes an external I/F 71*e*, a control information I/F 71*f*, and an image data I/F 71*g*. Further, the higher-level device 71 includes a bus 71*h* that connects the CPU 71*a* and the like. In other words, in the higher-level device 71, the CPU 71*a* and the like are connected to one another to be able to perform transmission and reception mutually via the bus 71*h*.

The CPU 71*a* controls an entire operation of the higher-level device 71. The CPU 71*a* uses a control program stored in the ROM 71*b* and/or the HDD 71*d* to control the operation of the higher-level device 71.

The ROM 71*b*, the RAM 71*c*, and the HDD 71*d* store data and the like, the ROM 71*b* and/or the HDD 71*d* store the control program to control the CPU 71*a* in advance, and the RAM 71*c* is used as a work memory for the CPU 71*a*.

The external I/F 71*e* controls communication (transmission and reception) with an external device (such as the host device) placed outside the image formation apparatus 100. The control information I/F 71*f* controls communication of control information data. The image data I/F 71*g* controls communication of print image data. The image data I/F 71*g* in the present embodiment has a plurality of channels (described below) for each color of the print image data.

The higher-level device 71 of the control unit 70 according to the present embodiment receives print job data at the external I/F 71*e*, the print job data being transmitted from the host device, and uses the CPU 71*a* to store the print job data in the HDD 71*d*. The higher-level device 71 further uses the CPU 71*a* to read out the print job data from the HDD 71*d*. Further, the higher-level device 71 uses the CPU 71*a* to create bitmap data about each color (yellow (Y), cyan (C), magenta (M), and black (K)) based on the print job data that is read out, and stores created bitmap data about each color in the RAM 71*c*. In this case, the higher-level device 71 (CPU 71*a*) can create bitmap data about each color by rendering with Page Description Language (PDL), for example, as an RIP process and write the bitmap data onto the RAM 71*c*.

Next, the higher-level device 71 compresses and encodes the bitmap data about each color written onto the RAM 71*c* and temporarily stores encoded bitmap data in the HDD 71*d*.

Then, when a print operation starts at the printer device 72, the higher-level device 71 (CPU 71*a*) reads out the encoded bitmap data about each color from the HDD 71*d*, decodes the encoded bitmap data, and writes each set of bitmap data about the corresponding color in the RAM 71*c*. Then, the higher-level device 71 reads out the bitmap data about each color from the RAM 71*c* and outputs the bitmap data as print image data about each color to the printer device 72 (printer engine 72E described below) via each channel of the image data I/F 71*g*. In this case, the higher-level device 71 can output the print image data to the printer device 72 via the data lines 70LD (70LD-Y, 70LD-C, 70LD-M, and 70LD-K) as the channels of the image data I/F 71*g* shown in FIG. 11.

Further, in accordance with progress of the print operation, the higher-level device 71 according to the present embodiment uses the CPU 71*a* to transmit or receive control information data to or from a printer controller 72C of the printer device 72 via the control information I/F 71*f* (control line 70LC).

Further, when a post-treatment starts at the post-treatment unit 50, the higher-level device 71 according to the present embodiment uses the CPU 71*a* to read out encoded image data about the post-treatment from the HDD 71*d* and outputs the image data to the printer engine 72E via a data line 70LD-P (FIG. 11) in the same manner as the above-mentioned bitmap data.

(Printer Device)

Figure 11:
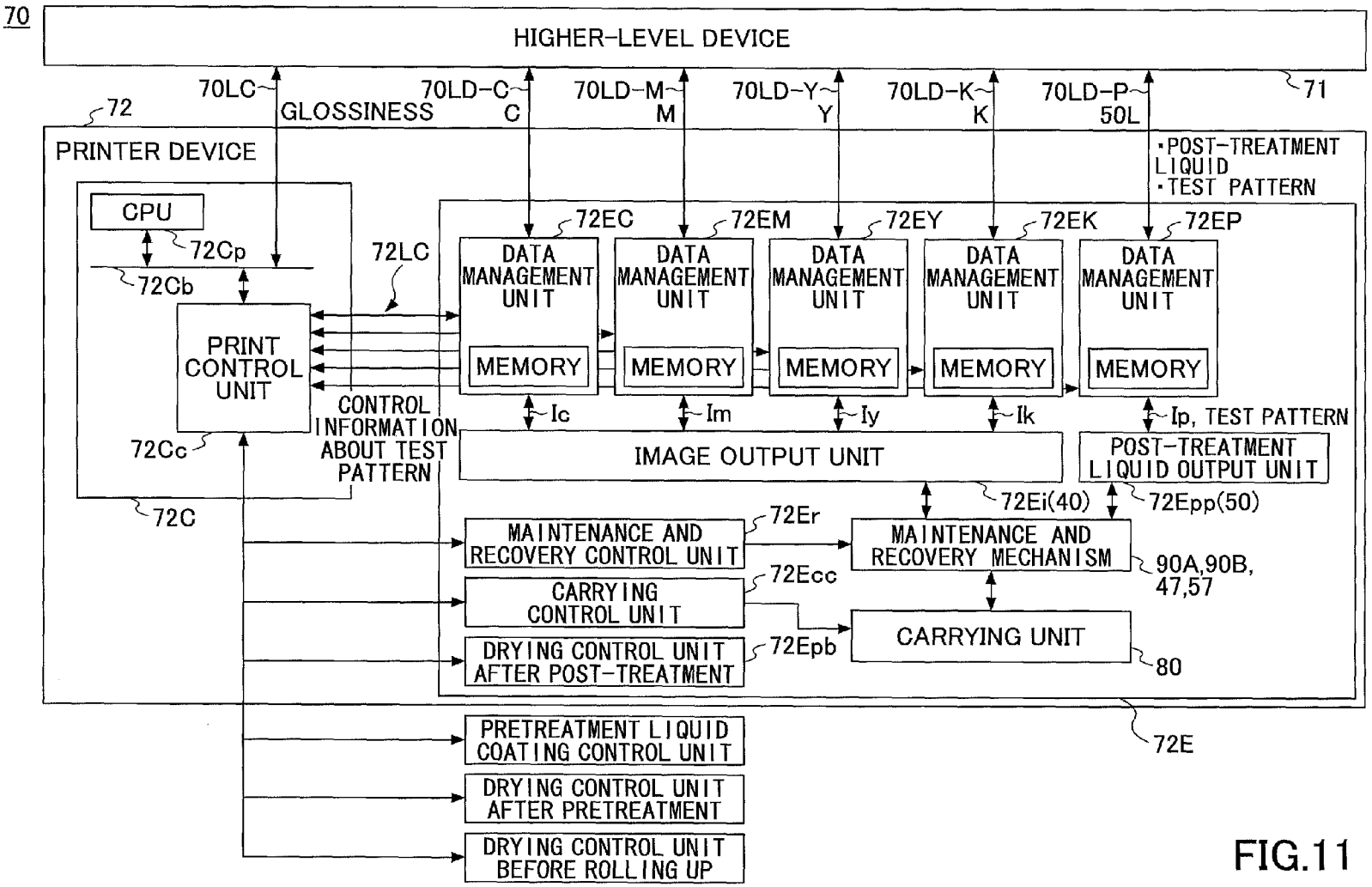
FIG. 11 is a functional block diagram illustrating functions of a control unit of an image formation apparatus according to an embodiment of the present invention.

The printer device 72 of the control unit 70 in the image formation apparatus 100 according to the embodiment of the present invention controls an operation to form an image on a recording medium based on the print image data and the control information data input from the higher-level device 71. The printer device 72 in the present embodiment includes the printer controller 72C and the printer engine 72E. As shown in FIGS. 1 and 11, the printer engine 72E includes the case (for carrying) 73, the case (inkjet printer body) 74, the image formation unit (head) 40, the post-treatment unit (head) 50, the maintenance and recovery units 90A and 90B, and the post-treatment drying unit 32.

The printer controller 72C controls an operation of the printer engine 72E described below. The printer controller 72C transmits or receives the control information data to or from the higher-level device 71 via the control line 70LC. Further, the printer controller 72C transmits or receives the control information data to or from the printer engine 72E via a control line 72LC. In accordance with this, the printer controller 72C can store print conditions by writing print information such as various types of print conditions included in the control information data and data about a test pattern for discharge in a register of a print control unit 72Cc. Further, the printer controller 72C can control the printer engine 72E based on the control information data and perform printing in accordance with the print job data (control information data).

As shown in FIG. 11, the printer controller 72C in the present embodiment includes a CPU 72Cp and the print control unit 72Cc. Further, in the printer controller 72C, the CPU 72Cp and the print control unit 72Cc are connected to each other to be able to perform transmission and reception mutually via a bus 72Cb. The bus 72Cb here is connected to the control line 70LC via a communication I/F.

The CPU 72Cp uses the control program stored in a ROM to control an entire operation of the printer device 72. The print control unit 72Cc transmits or receives a command and status information to or from the printer engine 72E based on the control information data transmitted from the higher-level device 71. In accordance with this, the print control unit 72Cc can control an operation of the printer engine 72E.

The printer engine 72E controls an operation to form an image on a recording medium based on the print image data input from the higher-level device 71 and the control information data input from the printer controller 72C. Further, the printer engine 72E controls an operation for post-treatment based on the print image data (image data about post-treatment) input from the higher-level device 71 and the control information data (control data about post-treatment) input from the printer controller 72C.

As shown in FIG. 11, a plurality of data lines 70LD (70LD-Y, 70LD-C, 70LD-M, 70LD-K, and 70LD-P) are connected to the printer engine 72E. The printer engine 72E receives the print image data from the higher-level device 71 via the plurality of data lines 70LD. In accordance with this, the printer engine 72E can perform a print operation of each color and a post-treatment using a post-treatment liquid based on the received print image data.

The printer engine 72E in the present embodiment includes a plurality of data management units 72EC, 72EM, 72EY, 72EK, and 72EP. Further, the printer engine 72E includes an image output unit 72Ei to which a print image, for example, is input from the data management unit 72EC and a carrying control unit 72Ecc that controls carrying of a recording medium. Further, the printer engine 72E in the present embodiment includes a post-treatment liquid output unit 72Epp to which image data about post-treatment is input from the data management unit 72EP and a drying control unit after post-treatment 72Epb that controls an operation of the drying unit 30 (FIG. 1). Further, the printer engine 72E in the present embodiment further includes a maintenance and recovery control unit 72Er that controls an operation of a maintenance and recovery mechanism (maintenance and recovery units 90A and 90B and carriage position movement units 47 and 57 shown in FIG. 7).

Further, in the present embodiment, test patterns used for a maintenance and recovery operation to be described below other than normal printing are included as image data. In addition, the printer engine 72E may further include a pretreatment liquid coating control unit, a drying control unit after pretreatment, and a drying control unit before rolling up.

A configuration of the data management unit 72EC is described with reference to FIG. 12. In addition, a configuration of other data management units 72EM, 72EY, 72EK, and 72EP is the same as the configuration of the data management unit 72EC, so that a description thereof is omitted. The data management units 72EC, 72EM, 72EY, and 72EK used for image formation function as a first driving waveform creation unit. The data management unit 72EP related to discharge of a post-treatment liquid functions as a second driving waveform creation unit.

Figure 12:
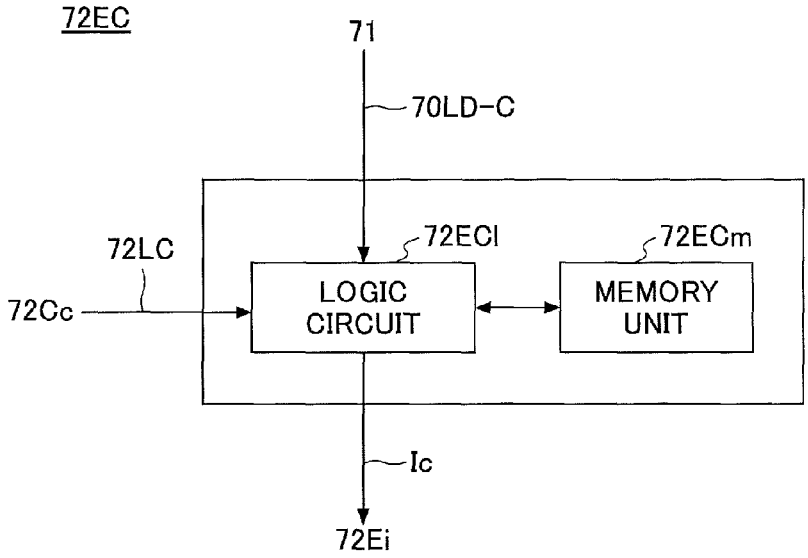
FIG. 12 is a functional block diagram illustrating a data management unit of a control unit of an image formation apparatus according to an embodiment of the present invention.

As shown in FIG. 12, the data management unit 72EC includes a logic circuit 72EC1 and a memory unit 72ECm. The data management unit 72EC (logic circuit 72EC1) is connected to the higher-level device 71 via the data line 70LD-C. The data management unit 72EC (logic circuit 72EC1) is also connected to the printer controller 72C (print control unit 72Cc) via the control line 72LC.

In the present embodiment, the memory unit 72ECm stores print image data output from the higher-level device 71 based on a control signal output from the printer controller 72C (print control unit 72Cc).

Further, the logic circuit 72EC1 reads out print image data (driving waveform) Ic (FIG. 12) corresponding to cyan (C) from the memory unit 72ECm based on the control signal output from the printer controller 72C (print control unit 72Cc) and outputs the print image data Ic to the image output unit 72Ei.

Specifically, the logic circuit 72EC1 of the data management unit 72EC creates the driving waveform by creating driving waveform data based on image data received from the higher-level device 71 and the print control unit 72Cc, performing digital-to-analog conversion on the created driving waveform data, and performing voltage amplification and current amplification.

As for post-treatment, in a case of a logic circuit 72ECp (data management unit 72EP), post-treatment liquid discharge data Ip (FIG. 11) about post-treatment and data to control a discharge position of a test pattern for a discharge examination are output to the post-treatment liquid output unit 72Epp.

The logic circuit 72ECp of the data management unit 72EP creates a driving waveform by creating driving waveform data based on a post-treatment liquid test pattern received from the higher-level device 71 and control information about the test pattern received from the print control unit 72Cc, performing digital-to-analog conversion on the created driving waveform data, and performing voltage amplification and current amplification.

The memory unit 72ECm here may have a capacity that can store print image data for at least three pages. The print image data for three pages includes print image data about a page being forwarded (received) from the higher-level device 71, print image data about a page being output to the image output unit 72Ei, and print image data about a next page, for example.

In addition, the data management unit 72EC may employ a hardware logic circuit configured with a combination of logic circuits, for example. In accordance with this, the data management unit 72EC can realize faster processing. Further, the data management unit 72EC may use the logic circuit 72EC1 to perform a logical decision on a control signal based on a bit string, for example, and determine a process to be performed.

A configuration of the image output unit 72Ei is described with reference to FIG. 13. A configuration of the post-treatment liquid output unit 72Epp is basically the same as the configuration of the image output unit 72Ei, so that a description thereof is omitted.

Figure 13:
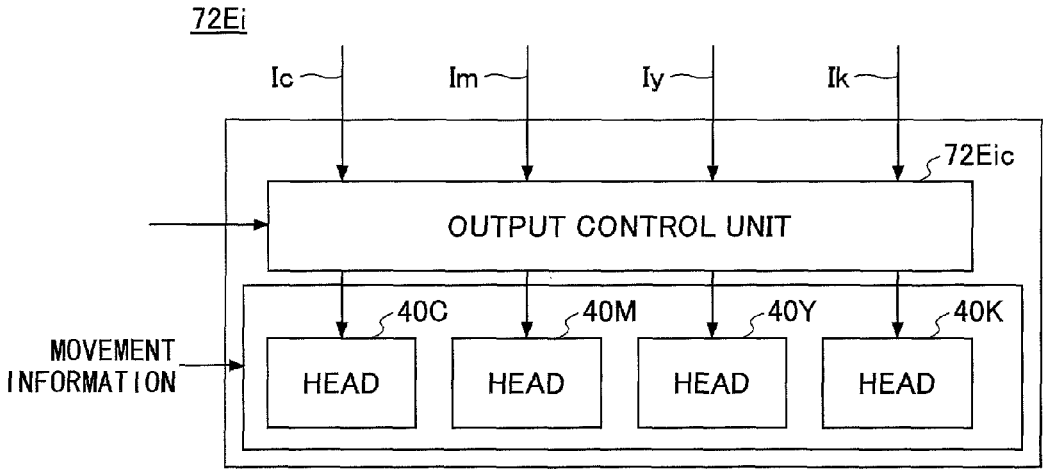
FIG. 13 is a functional block diagram illustrating an image output unit of a control unit of an image formation apparatus according to an embodiment of the present invention.

As shown in FIG. 13, the image output unit 72Ei includes an output control unit 72Eic. The output control unit 72Eic outputs print image data about each color to the corresponding discharge heads 40C, 40M, 40Y, and 40K (FIG. 4). Specifically, driving waveforms created by the logic circuits of the data management units 72EC, 72EM, 72EY, and 72EK are applied to the piezoelectric element 45P that serves as a pressure generation unit in the discharge heads (first discharge units) 40C, 40M, 40Y, and 40K while timing of the driving waveforms is controlled by the output control unit 72Eic. When the driving waveform is applied, the piezoelectric element 45P is expanded or contracted. Force of expansion or contraction acts on ink within a pressure chamber 40R from the piezoelectric element 45P via the vibration plate 42. When a pressure change occurs within the pressure chamber 40R, ink droplets are discharged from the nozzles 40N. In this manner, the output control unit 72Eic can control an operation of the discharge head 40C and the like based on the print image data (driving waveform).

Specifically, the output control unit 72Eic individually controls a plurality of discharge heads 40C and the like. Further, the output control unit 72Eic may simultaneously control the plurality of discharge heads 40C and the like using print image data (such as Ic in FIG. 13) that is input. Further, the output control unit 72Eic may control the discharge heads 40C and the like based on a control signal that is input from a control device (not shown). The output control unit 72Eic may control the discharge head 40C and the like based on an operation input by a user, for example.

In the same manner as in FIG. 13, the post-treatment liquid output unit 72Epp includes an output control unit. The output control unit outputs post-treatment data to the head 50 (FIG. 4, second discharge unit). Specifically, driving waveforms created by a logic circuit of the data management unit 72EP are applied to the piezoelectric element 45P of the head 50 while timing of the driving waveforms is controlled by an output control unit. Ink droplets are discharged from the nozzles 50N in accordance with a pressure change having occurred within the pressure chamber 40R via the vibration plate 42. The output control unit can control an operation of the head 50 based on the post-treatment liquid discharge data Ip (driving waveforms).

Further, as mentioned above, as a part of a position movement recovery operation, positional information is input and controlled such that the image formation unit (image output unit) 40 and the post-treatment unit (post-treatment liquid output unit) 50 are moved vertically for maintenance and recovery by the position movement units when printing is not being performed.

In accordance with this, the printer device 72 according to the present embodiment uses the data management unit 72EC and the output control unit 72Eic to input print image data output from the higher-level device 71 to the plurality of discharge heads 40C and the like. In this case, the printer device 72 can control a set of the print image data about each color independently of other sets of the print image data. Further, the printer device 72 can easily change a configuration of the printer engine 72E in accordance with a number of colors of the print image data (such as C, M, Y, and K or only K) or a number of discharge heads. In other words, the printer device 72 provides advantageous effects on size reduction and low cost of an apparatus by installing therein only the data management unit 72EC and the like and the discharge head 40C and the like that are required.

In the printer device 72 according to the present embodiment, if full-color printing is to be performed with four colors such as K, C, M, and Y, the data management unit 72EC and the like can be disposed on the printer engine 72E. In accordance with this, the printer device 72 can use the output control unit 72Eic to connect each output from the data management unit 72EC and the like to the corresponding discharge head 40C and the like.

Further, in the printer device 72, if printing is to be performed with a single color such as K, only a single data management unit 72EK and the discharge head 40K can be disposed to give priority to cost reduction of an apparatus. In accordance with this, the printer device 72 can use the output control unit 72Eic to connect an output of the data management unit 72EK to the discharge head 40K.

Or, if printing is to be performed with a single color such as K, one data management unit 72EK and four discharge heads may be disposed to give priority to printing speed. In accordance with this, the image formation apparatus 100 can use the output control unit 72Eic to connect the output of the data management unit 72EK to each of the four discharge heads. In this case, the image formation apparatus 100 can print by overlapping (superposing) the same color (K) plural times. Accordingly, it is possible to realize high-speed printing (image formation) four times faster as compared with a case where image formation is performed by a single discharge head.

Example 1-1

Figure 14:
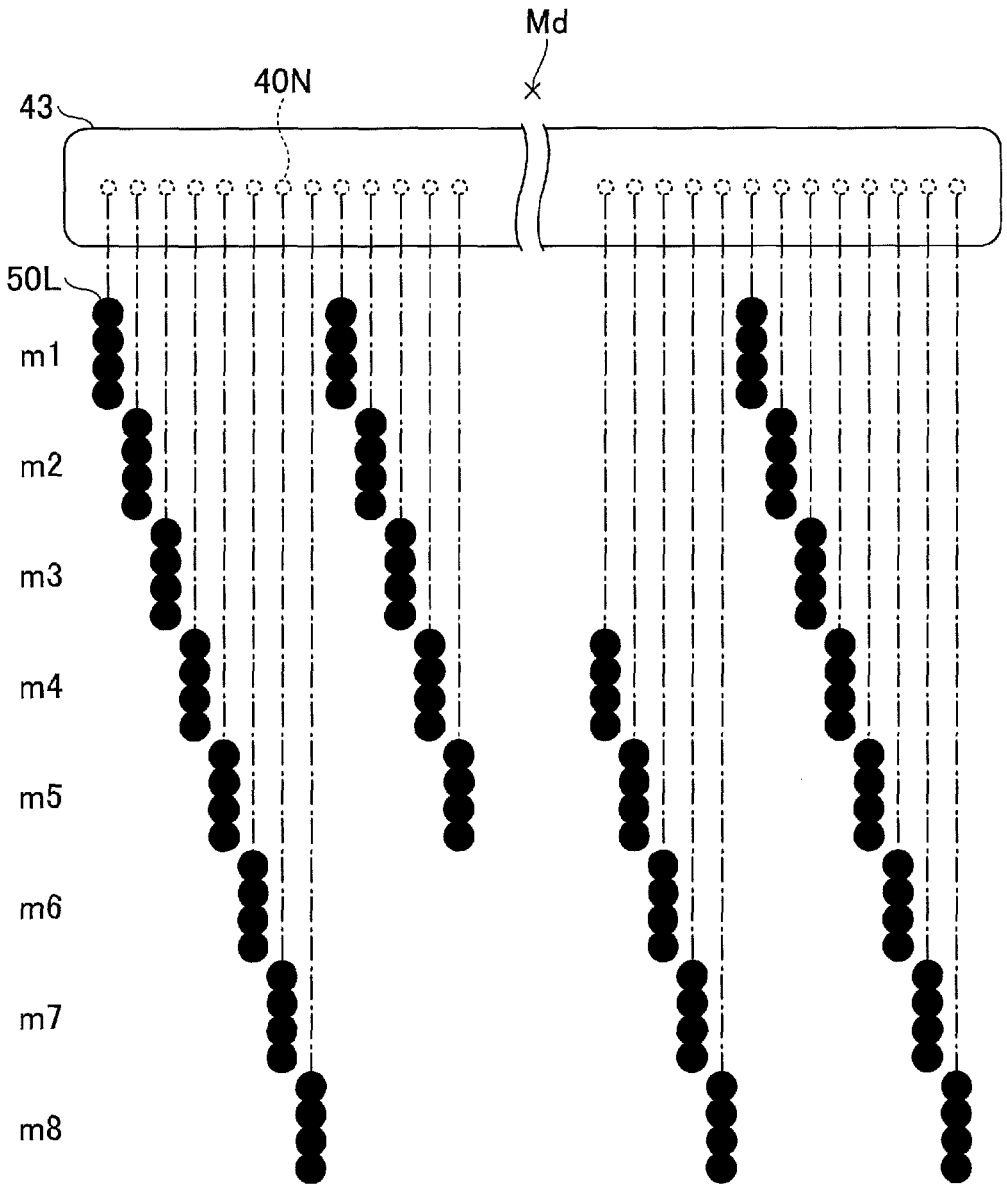
FIG. 14 is a diagram illustrating test patterns for a discharge examination of an image formation unit.

In the following, a specific example of the present invention in the above-mentioned image formation apparatus is described. In the specific example, the ink 40Ink and the post-treatment liquid 50L are discharged through droplets sent flying by a droplet discharge head. Before printing to form an image on a recording medium using this droplet flying method starts, test patterns for a discharge examination as shown in FIG. 14 are printed on the recording medium in order to check for an abnormal discharge such as a non-discharge or a curved discharge of ink droplets discharged by the ink jet head for each color. In these test patterns, an image is formed by discharging the ink 40Ink which is color droplets onto the recording medium from each of the nozzles 40N, so that it is possible to visually examine the test patterns. However, in a case of the post-treatment liquid 50L which is transparent droplets (transparent ink), when test patterns for a discharge examination are printed on the recording medium in the same method as mentioned above, it is difficult to examine the test patterns by visual observation due to transparency.

Figure 15:
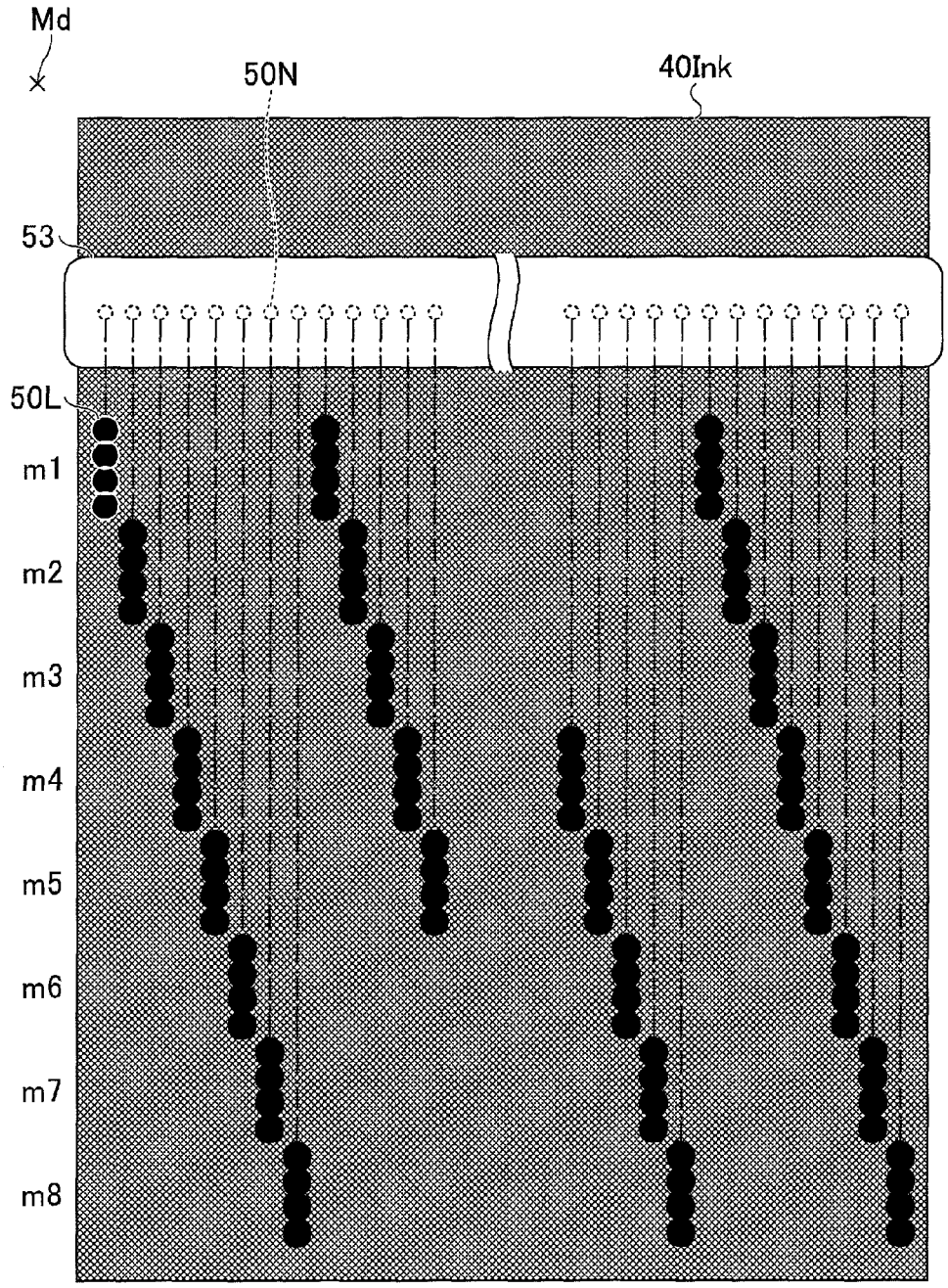
FIG. 15 is a diagram illustrating test patterns for a discharge examination of a post-treatment unit according to Example 1-1 of the present invention.

Accordingly, in order to examine a discharge (discharge operation) of the post-treatment liquid 50L, as shown in FIG. 15, for example, it is necessary to print an area (solid area) on the recording medium in advance, the area being filled with a single color using color ink (40Ink) in a peripheral part of the test patterns of the post-treatment liquid 50L to be printed. When the test patterns of the post-treatment liquid 50L are printed on the solid area, it becomes easy for the human eyes to recognize the test patterns.

This examination uses an illusion phenomenon that occurs in human color recognition. Specifically, when the post-treatment liquid 50L is printed on the area (solid area) filled with a single color using the color ink, a color contrast phenomenon such as brightness contrast, chroma contrast, and hue contrast occurs by which how an object is seen is changed in accordance with a peripheral color. Accordingly, the test patterns of the post-treatment liquid 50L becomes more recognizable by visual observation with the use of the illusion phenomenon that occurs in human color recognition.

Further, when an ink image is printed on the recording medium and test patterns of the post-treatment liquid 50L for a discharge examination are printed thereon, the ink image is preferably an image filled with a single color (solid image), so that the test patterns of the post-treatment liquid for the discharge examination become recognizable by visual observation. This is because if the image is filled with a plurality of colors or has a pattern or tones, the color image becomes noticeable by the human eyes so that the illusion phenomenon is less likely to occur, and the test patterns of the post-treatment liquid which are transparent droplets become less recognizable.

The single color is not limited to use of only a single color from color ink but ink of a plurality of colors may be used to print an image filled with a single color (solid image). This single color may be selected where necessary by searching for colors and density thereof in advance in order to be able to visually examine easily depending on recording mediums.

In the following, an operation (pull-push injection operation) to discharge ink from the nozzles 40N by the discharge head is specifically described.

First, the discharge head in the present embodiment lowers a voltage from a reference potential, the voltage being applied to the piezoelectric element 45P (pressure generation unit 45), to contract the piezoelectric element 45P in a lamination direction thereof. Further, the discharge head causes the vibration plate 42 to have deflective deformation due to the contraction of the piezoelectric element 45P. In this case, the discharge head increases (expands) capacity (volume) of the liquid chamber 40F by the deflective deformation of the vibration plate 42. In accordance with this, the discharge head can make ink flow into the liquid chamber 40F from the common liquid chamber 40D.

Next, the discharge head raises the voltage applied to the piezoelectric element 45P to expand the piezoelectric element 45P in the lamination direction. Further, the discharge head deforms the vibration plate 42 in a direction of the nozzles 40N by the expansion of the piezoelectric element 45P. In this case, the discharge head reduces (contracts) the capacity (volume) of the liquid chamber (pressure chamber) 40F by the deformation of the vibration plate 42. In accordance with this, the discharge head can apply pressure to the ink within the liquid chamber 40F. Further, the discharge head can discharge (inject) the ink from the nozzles 40N by pressurizing the ink.

Then the discharge head returns the voltage applied to the piezoelectric element 45P to the reference potential and returns (restores) the vibration plate 42 to an initial position. In this case, the discharge head depressurizes the liquid chamber 40F by expanding the liquid chamber 40F and fills (supplies) the liquid chamber 40F with ink from the common liquid chamber 40D. Next, the discharge head proceeds to an operation to discharge another ink after a vibration of a meniscus surface of the nozzles 40N is attenuated (stabilized) and repeats the above-mentioned operation.

In addition, a method for driving the discharge head that can use the present invention is not limited to the above-mentioned example (pull-push injection operation). In other words, the method for driving the discharge head can perform pull-injection or push-injection by controlling a voltage (driving waveform) applied to the piezoelectric element 45P.

In accordance with this, the image formation apparatus 100 according to the present embodiment can form a black and white or full-color image in the entire area of the image formation region by using the image formation unit 40 (four discharge heads 40K, 40C, 40M, and 40Y) in a single carrying operation of the recording medium (roll paper Md).

Further, when printing is not performed such as before printing, test patterns are created in order to determine necessity of maintenance. For such test patterns, test patterns to detect clogging of the heads of each color in the image formation unit 40 and test patterns to detect clogging of the head in the post-treatment unit 50 are created. In addition, the image formation unit 40 preferably forms a solid image with a single color selected from any one of the four colors in order to detect the clogging of the head in the post-treatment unit 50.

In order to examine the clogging of the head in the post-treatment unit 50, a predetermined image is formed with color droplets discharged from the image formation unit 40 when any one of the data management units (first driving waveform creation unit) 72EC, 72EM, 72EY, and 72EK applies a driving waveform for continuously discharging droplet dots to a plurality of piezoelectric elements within a plurality of nozzles in a nozzle line of the image formation unit 40.

FIG. 15 is a diagram illustrating test patterns for a discharge examination of the post-treatment unit 50 according to Example 1-1 of the present invention. In the test patterns for an examination of the post-treatment unit 50 shown in FIG. 15, the test patterns discharged from the image formation unit 40 form a solid image. Accordingly, a driving waveform created by any one of the data management units 72EC, 72EM, 72EY, and 72EK for image formation (see FIG. 11) has a form as shown in FIG. 16, for example.

Figure 16:
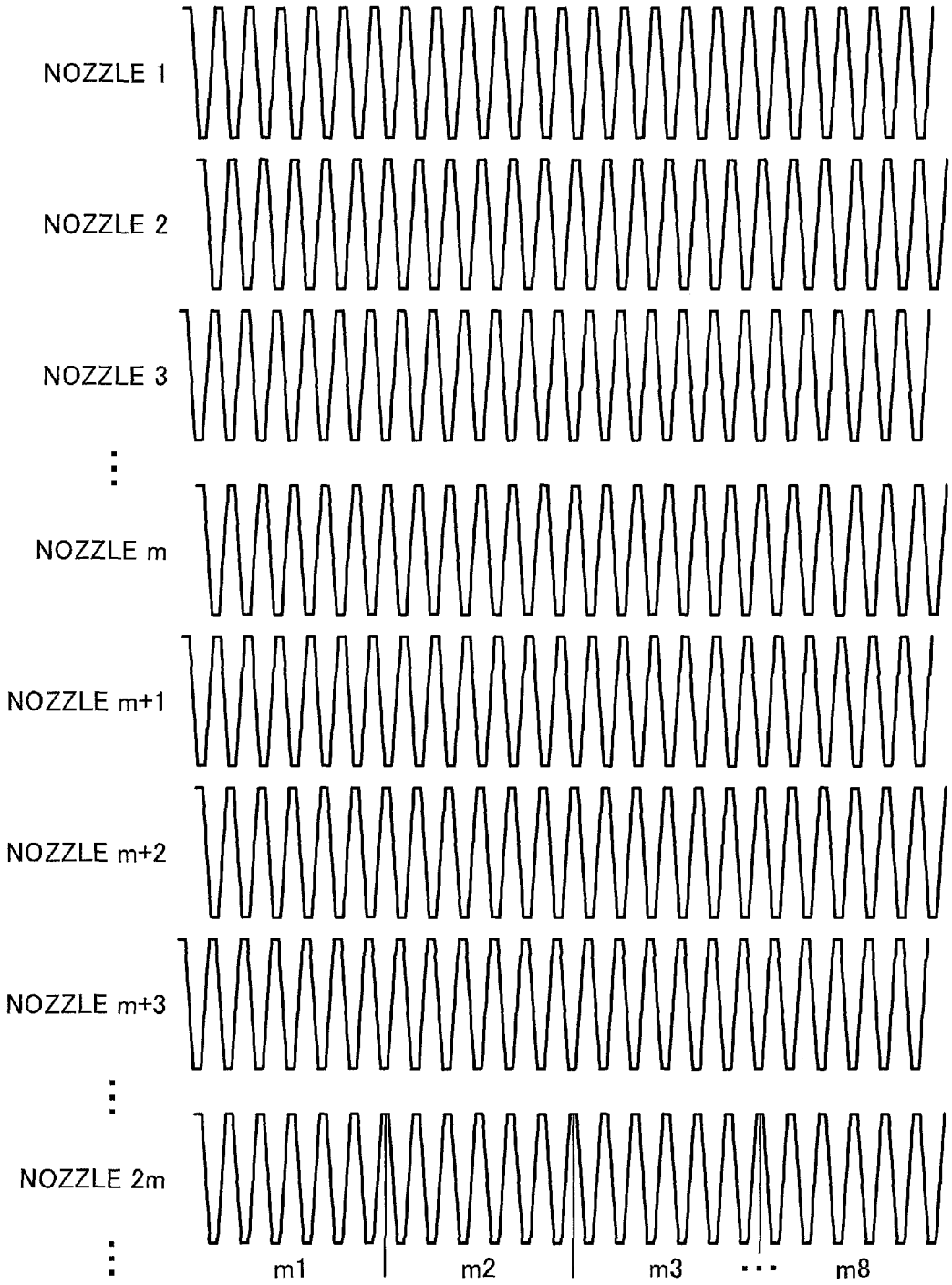
FIG. 16 is a diagram illustrating driving waveforms of an image formation unit when forming the test patterns for a discharge examination shown in FIG. 15.

FIG. 16 shows a driving waveform of the image formation unit 40 when forming the test patterns for a discharge examination shown in FIG. 15. As shown in FIG. 16, a waveform for a large droplet is continuously applied in order to create a solid area which is a field to be filled by arranging ink dots. In addition, a phase of the driving waveform to be applied to an adjacent nozzle may be shifted so as not to have a space in the solid area.

In the test patterns for an examination of the post-treatment unit 50 shown in FIG. 15, linear patterns are discharged from the post-treatment unit 50. A driving waveform created by the data management unit 72EP for post-treatment liquid output has a form as shown in FIG. 17, for example.

Figure 17:
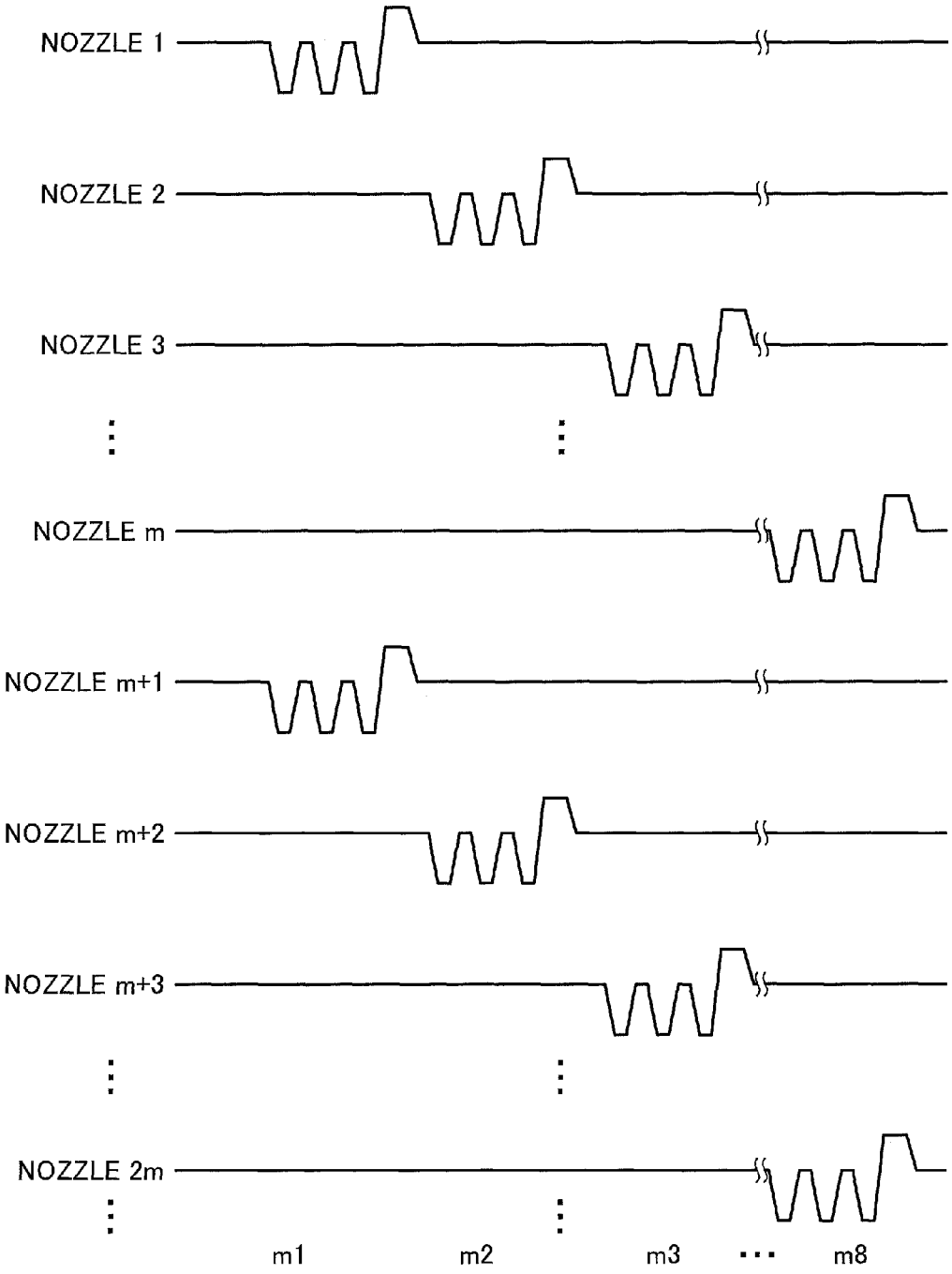
FIG. 17 is a diagram illustrating driving waveforms of the post-treatment unit when forming the test patterns for a discharge examination shown in FIG. 15.

FIG. 17 is a diagram illustrating a driving waveform of the post-treatment unit 50 when forming test patterns for a discharge examination shown in FIG. 15. In FIG. 17, the driving waveform expands and contracts the liquid chamber 40F to discharge four droplets by rising and falling from the reference potential four times. A rising and falling from the reference potential set last in the driving waveform also functions as a vibration control waveform to stabilize meniscuses of ink in the nozzles.

Specifically, when a discharge operation of the post-treatment unit 50 is examined, the following waveform control is performed after a predetermined image is formed with color droplets by the image formation unit 40 as mentioned above.

The data management unit 72EP (second driving waveform creation unit) forms a first pattern line where a plurality of dots are arranged by applying a second driving waveform for discharging a predetermined number of transparent droplets to a plurality of second piezoelectric elements 45P disposed at (m−1) intervals and facing a plurality of nozzles 50N disposed at (m−1) intervals in a nozzle line of the post-treatment unit 50.

Further, after (immediately after) the first pattern line is formed, the data management unit 72EP forms a second pattern line by applying the second driving waveform for discharging the predetermined number of transparent droplets to a plurality of second piezoelectric elements 45P facing nozzles adjacent to the plurality of nozzles 50N disposed at (m−1) intervals.

In this manner, after the second driving waveform is applied to the adjacent nozzles (piezoelectric elements facing the nozzles), the data management unit 72EP forms m pattern lines in a first direction which is a relative movement direction as shown in FIG. 15 by successively applying the second driving waveform m times in total.

Figure 18:
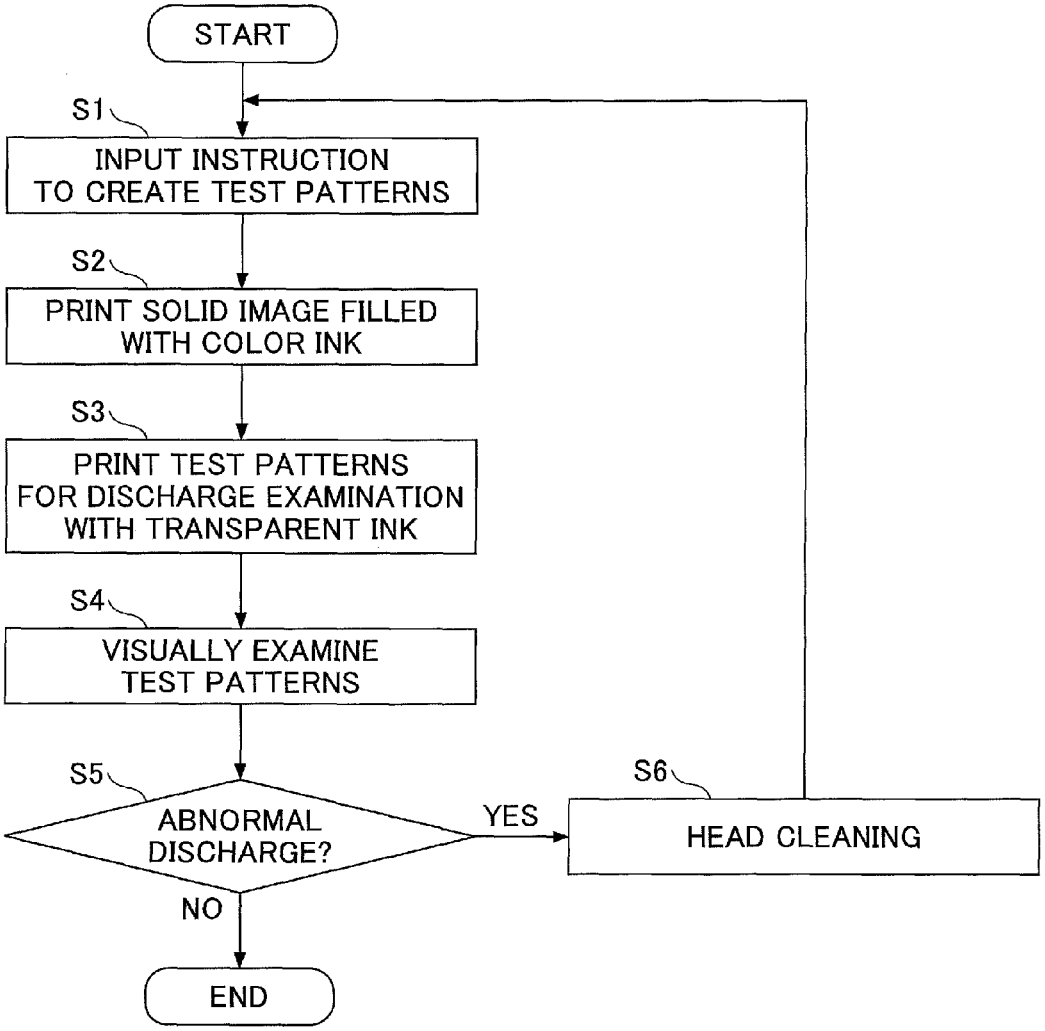
FIG. 18 is a flowchart of steps of a discharge examination of transparent droplets of the post-treatment unit according to Example 1-1 of the present invention.

A flow of steps to examine a discharge of a post-treatment liquid using the above-mentioned method is described with reference to FIG. 18. FIG. 18 is a flowchart of steps to examine a discharge of the post-treatment liquid. First, before printing, an instruction to create test patterns is input (S1). Then, a solid image (predetermined image) filled with color ink is printed (image formation) on a recording medium (S2). Subsequently, discharge patterns (patterns) are formed with the post-treatment liquid on the formed solid image and printed (S3).

The head serving as the post-treatment unit 50 includes a nozzle line that discharges transparent droplets onto the recording medium where the solid image is formed while moving relative to the recording medium. In the nozzle line, a plurality of nozzles 50N are arranged in a second direction orthogonal to the first direction which is the relative movement direction.

When the discharge patterns are formed in S3, the post-treatment unit 50 serving as a discharge unit discharges the post-treatment liquid (transparent droplets) from each of the nozzles 50N in the nozzle line arranged in the second direction, so that m (m: a natural number more than 1) pattern lines where a plurality of patterns are arranged in the second direction are formed in the first direction on the recording medium and the plurality of patterns are arranged at (m−1) intervals in each of the m pattern lines. For example, in FIG. 15, a number of the pattern lines m is eight and the plurality of patterns are arranged at seven line intervals in the pattern lines.

The printed test patterns are visually examined (S4) to check whether there is an abnormal discharge such as a non-discharge or a curved discharge of the post-treatment liquid (S5).

If the abnormal discharge is confirmed (Yes in S5), cleaning of the head 50 is performed by the maintenance and recovery unit 90B (S6) shown in FIGS. 7-9 and this flow is repeated until there is no such abnormal discharge. If no abnormal discharge is confirmed (No in S5), this discharge examination ends.

When control is performed in this manner, even if the post-treatment liquid is transparent and colorless, it is possible to visually examine a discharge with ease by printing an image with color ink on a recording medium and printing test patterns for a discharge examination on the image, the test patterns being printed with the transparent post-treatment liquid. In addition, the control of this discharge examination may be performed by the print control unit (computer) 72Cc.

With this method, an abnormal discharge of the post-treatment liquid is eliminated, so that it is possible to prevent detachment the image (ink) or deterioration of abrasion resistance, glossiness, and preservation stability (such as water resistance, light resistance, and gas resistance) of the image on the recording medium that may result from a non-discharge of the post-treatment liquid. Accordingly, it is possible to provide an image formation apparatus with improved reliability by applying this method for examining a discharge of the post-treatment liquid by the image formation apparatus.

When the solid image is printed with color ink on the recording medium, as ink concentration becomes higher, an illusion phenomenon is more likely to occur in the test patterns printed with the post-treatment liquid on the solid image, so that recognition of the test patterns by visual observation becomes easy. However, in order to increase the ink concentration, an amount of ink to be discharged onto the recording medium is also increased. This will have a substantial influence on subsequent drying conditions. In view of this, the inventors have discovered that if a relative printing density between the solid image and the recording medium is not more than 2.0, it is possible to sufficiently dry the recording medium and to prevent transfer when the recording medium is carried.

By contrast, an amount of color ink to be consumed is preferably small in order to dry the ink so that the recording medium on which the test patterns are printed may be carried. If a discharging amount of the color ink is reduced, it is possible to further reduce cost. The inventors have discovered that in order to visually recognize the test patterns formed with the post-treatment liquid, the relative printing density between the filled image (solid image) and the recording medium may have a difference not less than 0.2.

Accordingly, by adjusting the image density of the color ink image printed on the recording medium when the image is formed such that the image density ranges from not less than 0.2 to not more than 2.0, it is possible to reduce the amount of color ink to be used while generating an illusion phenomenon, so that it is possible to perform a discharge examination at low cost.

Example 1-2

Figure 19:
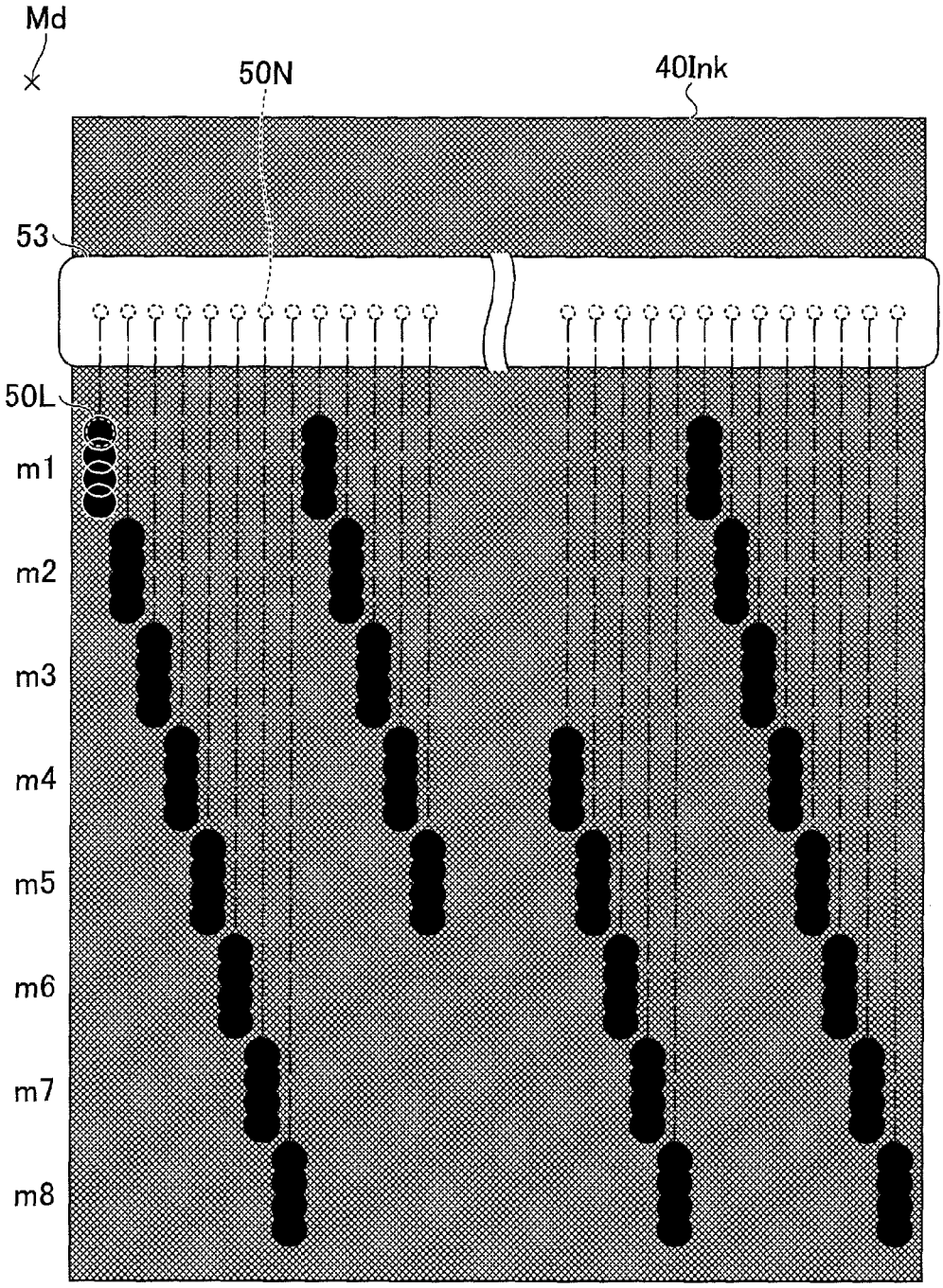
FIG. 19 is a diagram illustrating test patterns for a discharge examination of a post-treatment unit according to Example 1-2 of the present invention.

FIG. 19 is a diagram illustrating test patterns for a discharge examination of a post-treatment unit according to Example 1-2 of the present invention. In the present example, a dot diameter is set to be large by increasing an amount of droplets to be discharged.

Figure 20:
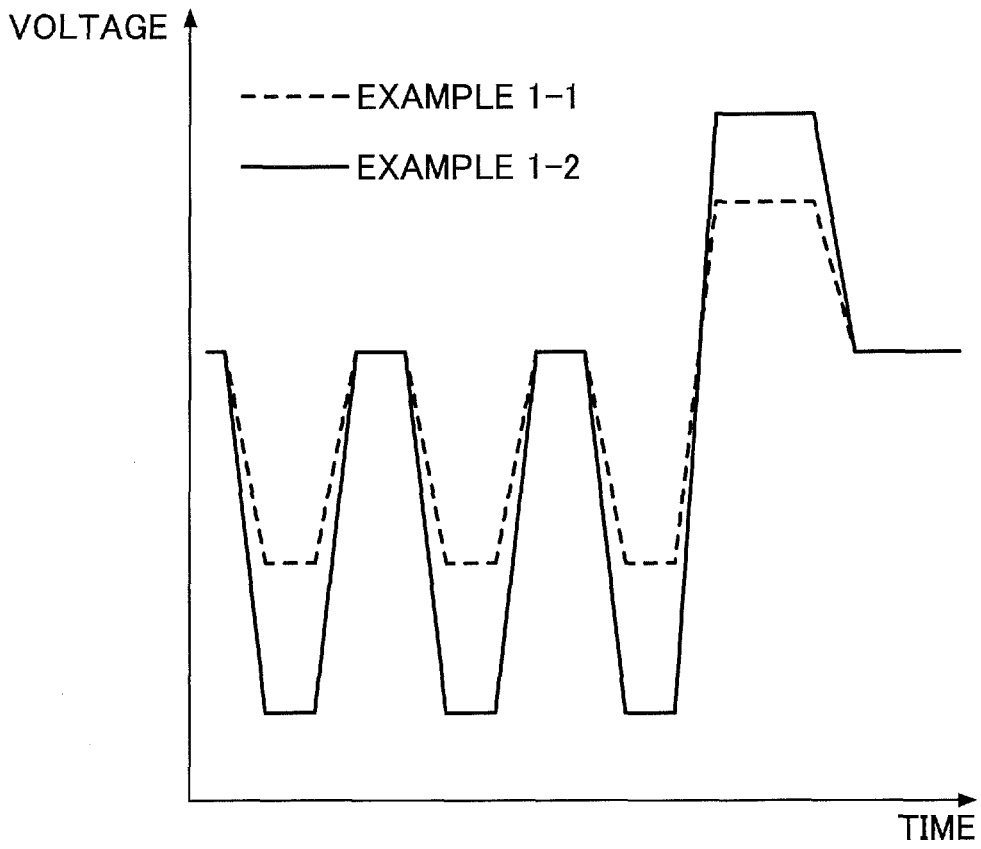
FIG. 20 is a diagram illustrating a driving waveform of the post-treatment unit when forming the test patterns for a discharge examination shown in FIG. 19.

FIG. 20 is a diagram illustrating a driving waveform of the post-treatment unit when forming the test patterns for a discharge examination shown in FIG. 19. In FIG. 20, a change of pressure in the liquid chamber 40F is increased by increasing a fluctuation range of voltage for a driving waveform in comparison with the driving waveform in Example 1-1 shown in FIG. 17, namely, by widening a reduction range and an increase range of an applied voltage (peak value). Accordingly, it is possible to increase the amount of droplets to be discharged.

Figure 21:
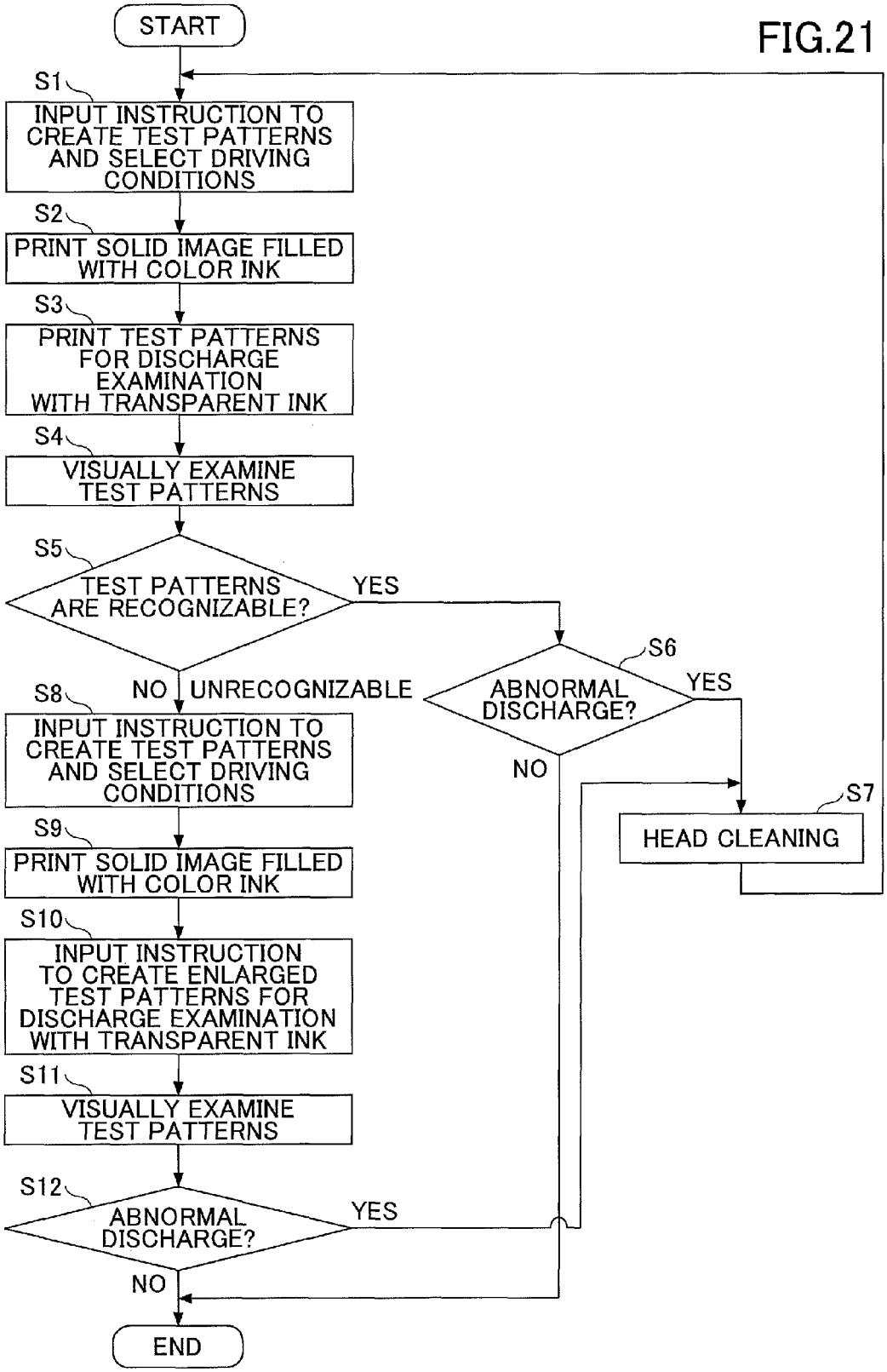
FIG. 21 is a flowchart of steps of a discharge examination of transparent droplets of the post-treatment unit according to Example 1-2 of the present invention.

FIG. 21 is a flowchart of steps of a discharge examination of transparent droplets of a post-treatment unit according to Example 1-2 of the present invention.

First, before printing, an instruction to create test patterns is input and the test patterns of Example 1-1 are selected first (S1). Then, a solid image (predetermined image) filled with color ink is printed (image formation) on a recording medium (S2).

Subsequently, discharge patterns (patterns) are formed with the post-treatment liquid on the formed solid image and printed (S3).

Then, the printed test patterns are visually examined (S4) to see whether the test patterns are recognizable (S5).

If the test patterns are recognizable (Yes in S5), whether there is an abnormal discharge such as a non-discharge or a curved discharge of the post-treatment liquid is checked (S6) in the same manner as in FIG. 18 mentioned above.

If the abnormal discharge is confirmed (Yes in S6), cleaning of the head 50 is performed by the maintenance and recovery unit 90B shown in FIGS. 7-9 (S7) mentioned above.

By contrast, when the test patterns are visually examined in S4, if the test patterns are unrecognizable (No in S5) due to poor visibility depending on a type of paper, the process proceeds to S8.

In S8, an instruction to create enlarged test patterns is input and test patterns of Example 1-2 (or Example 1-3 described below) are selected. Then, in the same manner as in S2, a solid image (predetermined image) filled with color ink is printed (image formation) on the recording medium (S9).

Enlarged test patterns are subsequently formed with the post-treatment liquid on the formed solid image and printed (S10).

Then, the printed test patterns whose visibility is improved by being enlarged are visually examined (S11) to check whether there is an abnormal discharge such as a non-discharge or a curved discharge of the post-treatment liquid (S12).

If the abnormal discharge is confirmed (Yes in S12), the process proceeds to S7 and cleaning of the head 50 is performed by the maintenance and recovery unit 90B (S7).

This flow is repeated until there is no such abnormal discharge.

If no abnormal discharge is confirmed (No in S6, S12), this discharge examination ends.

When control is performed in this manner, even if the post-treatment liquid is transparent and colorless, it is possible to visually examine a discharge with increased ease by printing an image with color ink on a recording medium and printing test patterns for a discharge examination on the image, the test patterns being printed with the transparent post-treatment liquid. In addition, the control of this discharge examination may be performed by the print control unit (computer) 72Cc.

Example 1-3

Figure 22:
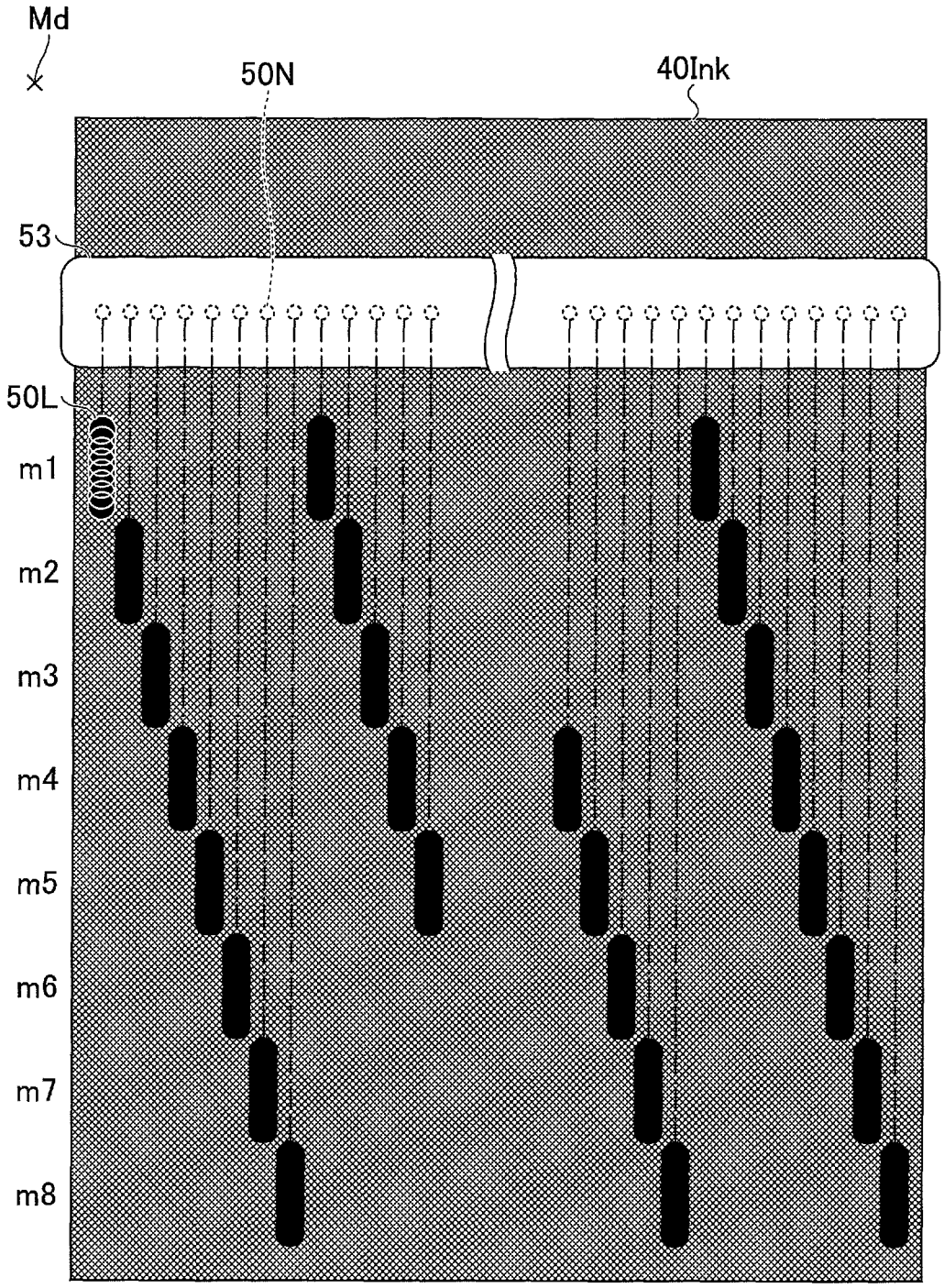
FIG. 22 is a diagram illustrating test patterns for a discharge examination of a post-treatment unit according to Example 1-3 of the present invention.

FIG. 22 is a diagram illustrating test patterns for a discharge examination of a post-treatment unit according to Example 1-3 of the present invention. In the present example, dot density is set to be high by increasing a number of droplets to be discharged per cycle.

Figure 23:
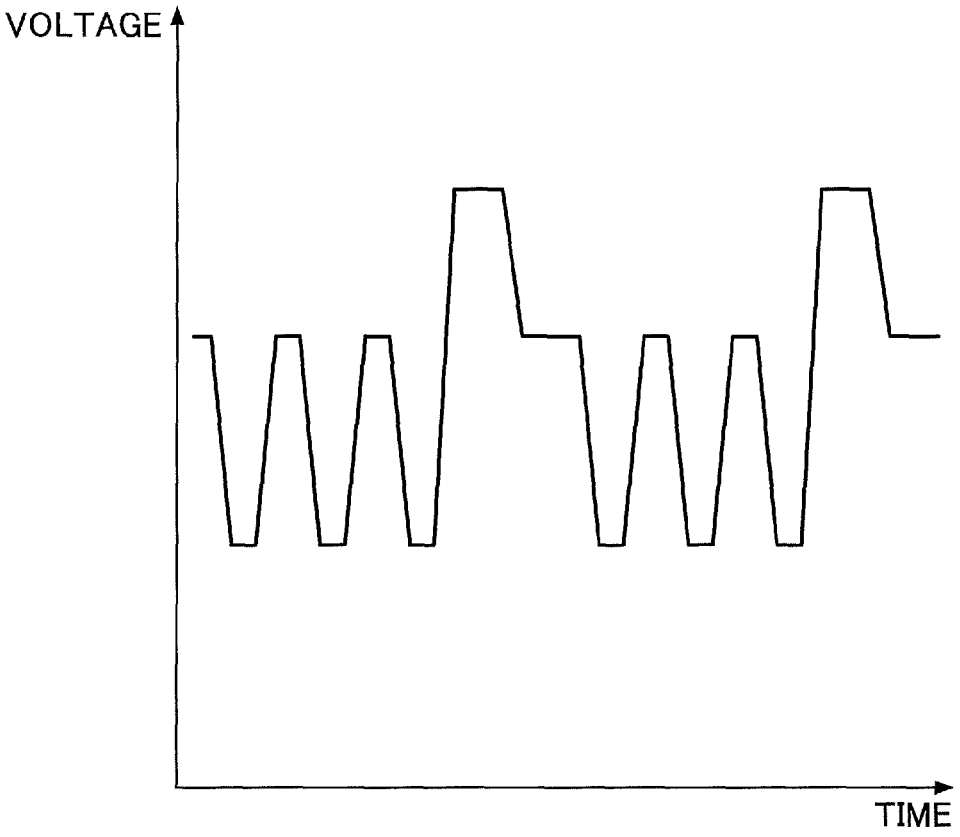
FIG. 23 is a diagram illustrating a driving waveform of the post-treatment unit when forming the test patterns for a discharge examination shown in FIG. 22.

FIG. 23 is a diagram illustrating a driving waveform of the post-treatment unit when forming the test patterns for a discharge examination shown in FIG. 22. In FIG. 23, it is possible to increase the number of droplets to be discharged per unit time by increasing a frequency of a driving waveform (discharge frequency). By increasing a number of discharge pulses per unit time relative to a previous waveform, it is possible to increase the number of droplets to be discharged.

If the number of droplets is increased in this manner and the droplets land on paper, it is possible to increase dot density and improve visibility in comparison with Example 1-1.

Example 2

Figure 24A:
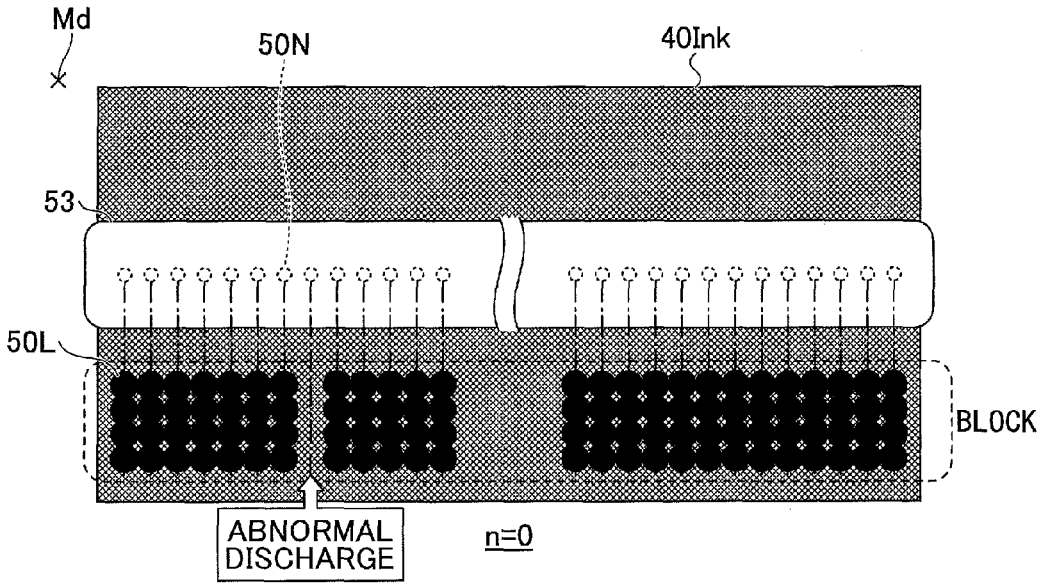
FIG. 24A is a diagram illustrating test patterns for a discharge examination of a post-treatment unit according to Example 2 of the present invention.
Figure 24B:
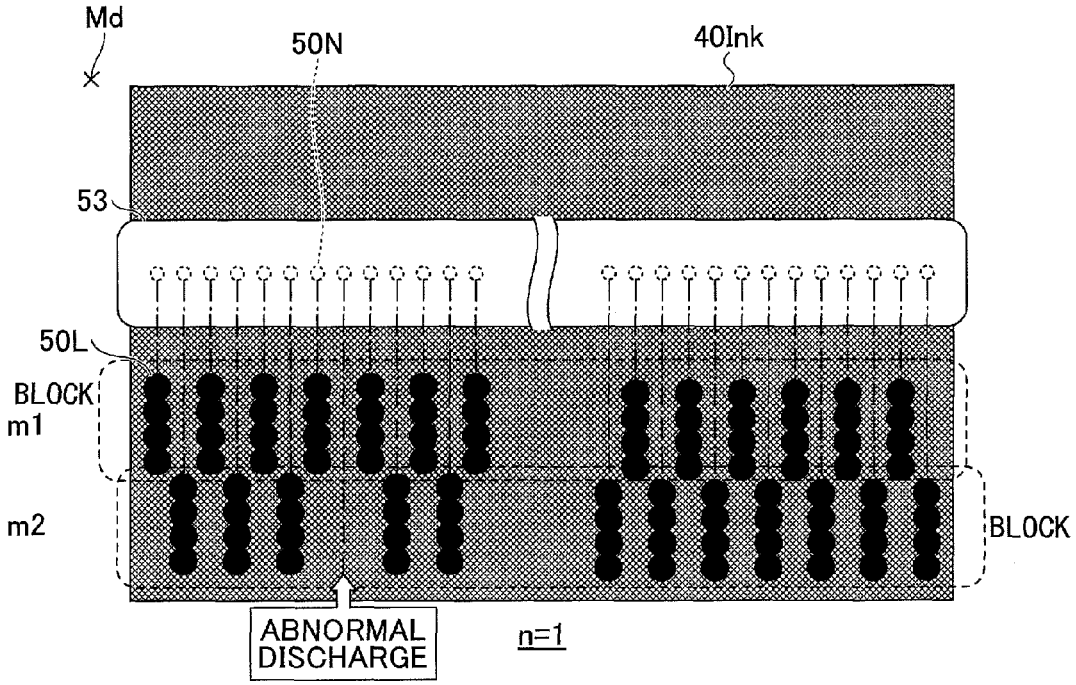
FIG. 24B is another diagram illustrating test patterns for a discharge examination of the post-treatment unit according to Example 2 of the present invention.
Figure 24C:
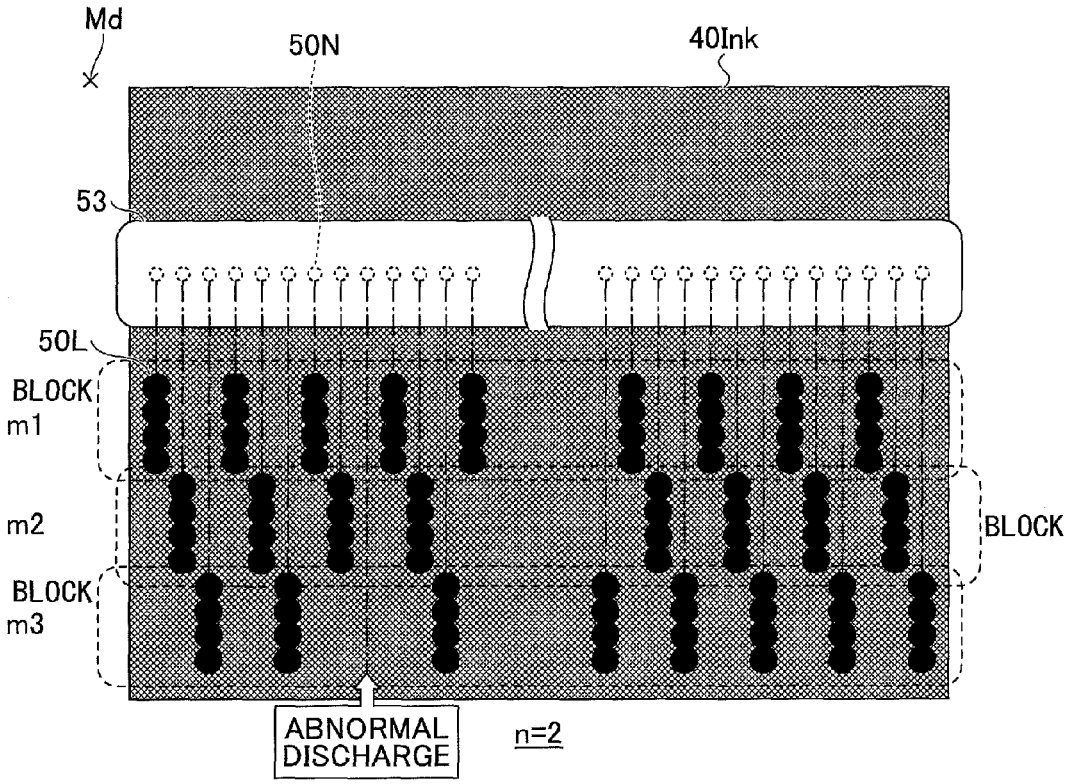
FIG. 24C is another diagram illustrating test patterns for a discharge examination of the post-treatment unit according to Example 2 of the present invention.

Example 2 of the present invention is described with reference to FIGS. 24A-24C. FIGS. 24A-24C show other examples of test patterns of the post-treatment liquid 50L, in which a solid area is formed first on the recording medium with a single color using the color ink 40Ink in a peripheral part of the test patterns of the post-treatment liquid 50L to be printed and the test patterns of the post-treatment liquid 50L are printed on the solid area.

In this case, when the post-treatment liquid 50L is discharged onto the solid area of the recording medium, a group (block) is formed and printed by discharging the post-treatment liquid 50L from every n-th (n is a natural number including 0) nozzle of a plurality of nozzles in a nozzle line of the head. In addition, in this nozzle line, the plurality of nozzles are arranged in the second direction orthogonal to the first direction (the carrying direction Xm of the recording medium in the present example) which is a relative movement direction with respect to the recording medium. In each block, the post-treatment liquid 50L is regularly arranged in a linear manner. If there is a curve or a missing portion in the regularly arranged linear block, this will be noticeably recognizable to the human eyes.

If the interval n=0, a solid image of the post-treatment liquid 50L is printed. In this case, the missing portion resulting from a non-discharge nozzle appears as a streak and becomes recognizable as an abnormal discharge by visual observation.

FIGS. 24A-24C show examples where the interval n=0 to n=2. However, the interval is not limited to this but a value of the interval may be selected where necessary for optimum recognition depending on a color or density of an area (solid area) filled with a single color using color ink (40Ink).

As in this example, if the test patterns for a discharge examination of the post-treatment liquid 50L are discharged from every n-th (n is a natural number including 0) nozzle of the plurality of nozzles in the nozzle line of the head and the group (block) is formed, it is possible to confirm occurrence of a discharge failure in a short time.

In addition, in consideration of ease of specification of a nozzle location having a discharge failure by visual observation, the interval is preferably provided (interval n=1 or more). For example, in FIG. 24B, two pattern lines (m=2) where a plurality of patterns are arranged in the second direction (lateral direction in FIG. 24) are formed in the first direction (longitudinal direction in FIG. 24B) on the recording medium. In each of the two pattern lines, a plurality of patterns are arranged at one pattern (number of pattern lines m−1=n) intervals (lateral direction). Further, in FIG. 24C, three pattern lines (m=3) where a plurality of patterns are arranged in the second direction are formed in the first direction (longitudinal direction in FIG. 24C) on the recording medium. In each of the three pattern lines, a plurality of patterns are arranged at two pattern intervals (lateral direction in FIG. 24C).

While pattern lines of this example have a shape in Example 1-1, pattern lines having a shape in Example 1-2 or Example 1-3 may be applied.

Example 3

Figure 25A:
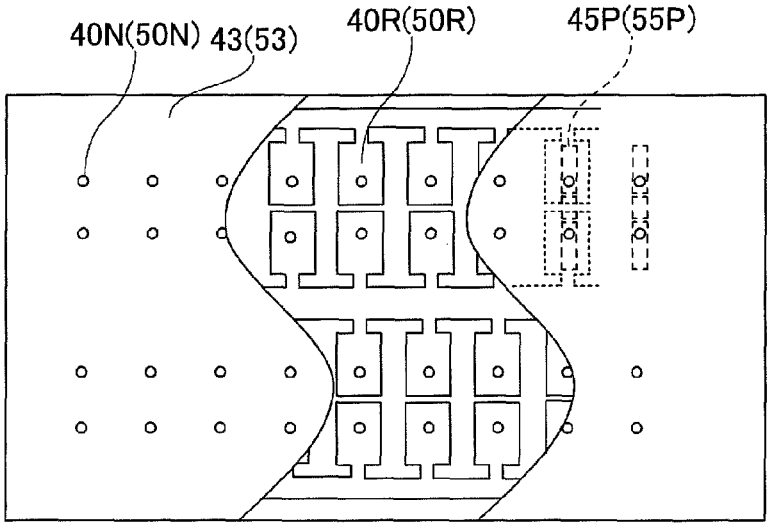
FIG. 25A is a diagram illustrating a discharge head of a post-treatment unit according to Example 3 of the present invention.
Figure 25B:
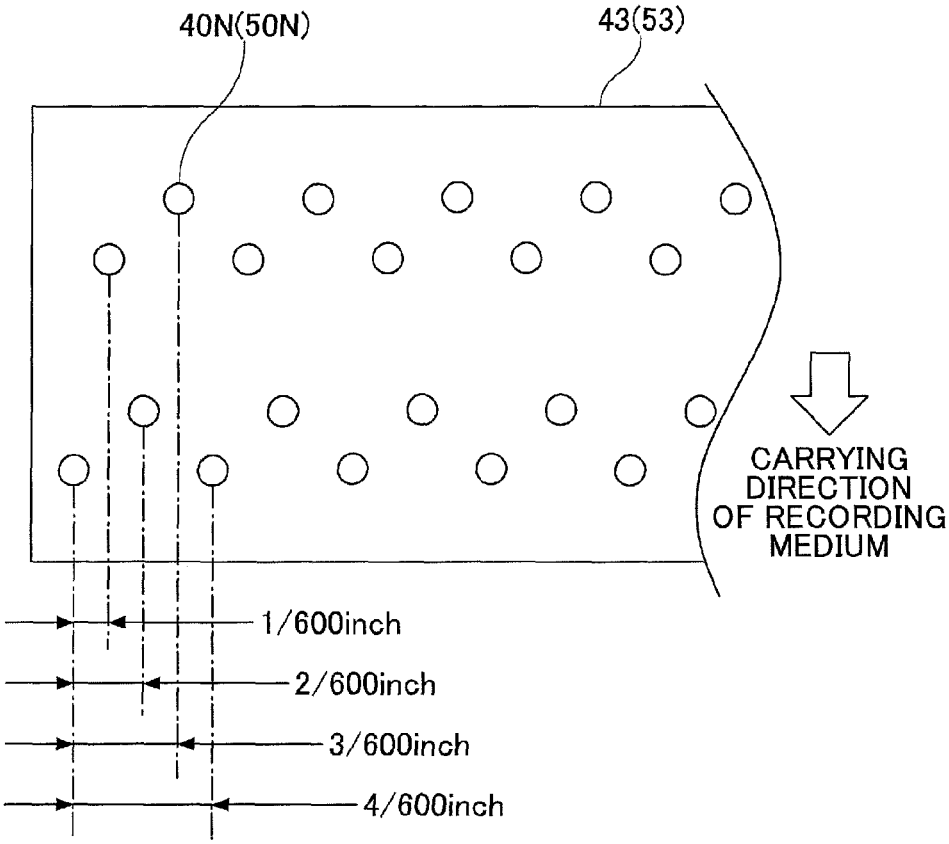
FIG. 25B is a diagram illustrating the discharge head of the post-treatment unit according to Example 3 of the present invention.

Example 3 of the present invention is described. A head of the post-treatment liquid 50L in the present example shown in FIG. 25A includes a plurality of discharge ports (nozzles, printing nozzles) 50N on an outer surface of the nozzle plate 53 in order to increase density of the nozzles and reduce a size thereof. In this case, the plurality of discharge ports 50N are arranged in four lines in a longitudinal direction of the head and constitute four nozzle lines. When the plurality of nozzle lines are formed, piezoelectric elements 55P and frame members 50R are disposed for the four lines of nozzles 50N. These nozzle lines are disposed in the carrying direction of the recording medium as shown in FIG. 25B, such that the nozzles of the nozzle lines are arranged at regular intervals such as 600 dpi.

Figure 26:
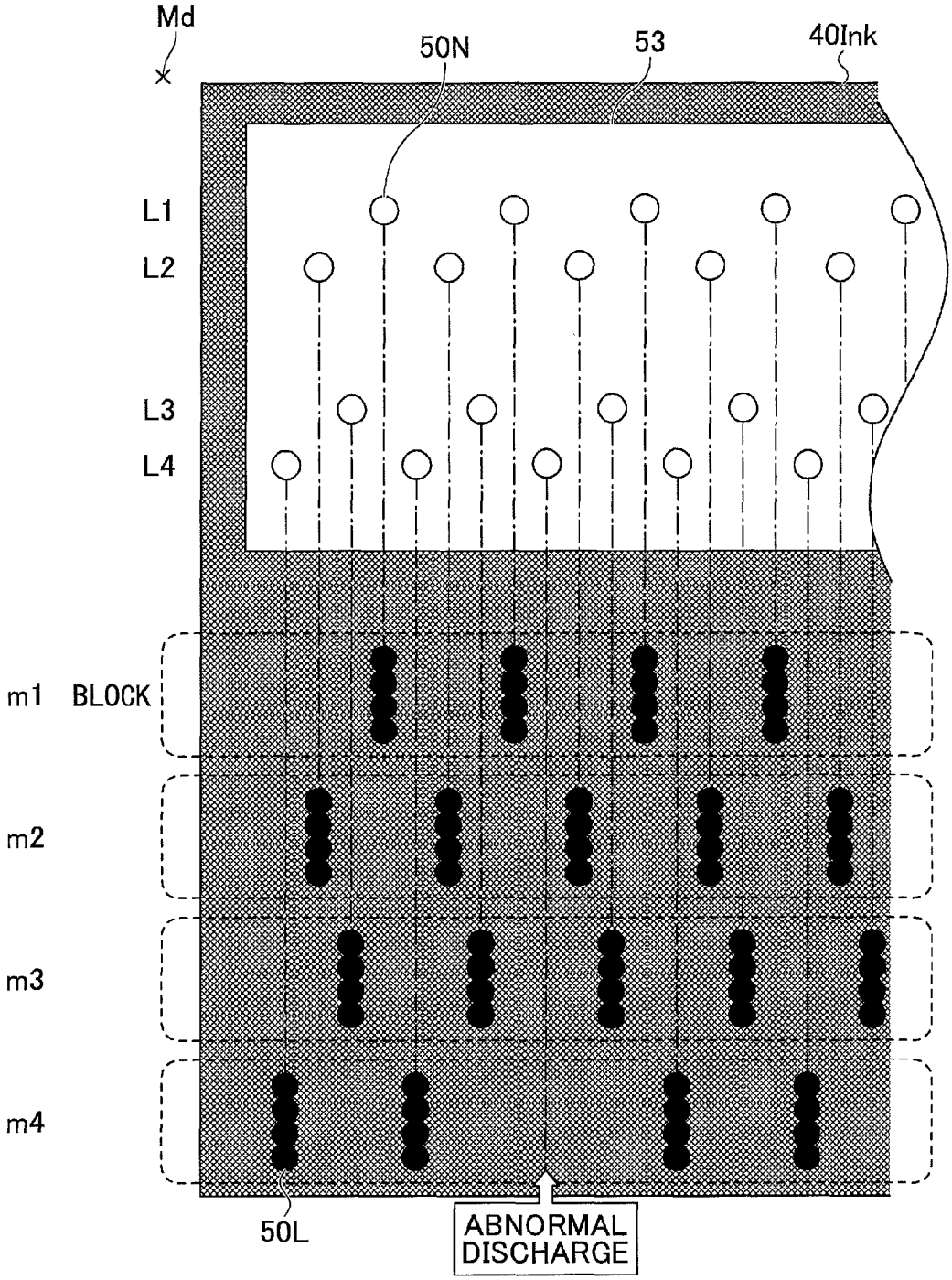
FIG. 26 is a diagram illustrating test patterns for a discharge examination using the discharge head shown in FIGS. 25A and 25B.

FIG. 26 shows that on an area (solid area, predetermined image) filled with a single color using color ink (shown by 40Ink), the post-treatment liquid 50L is discharged from the head of the present example and test patterns are printed (where nozzle lines L=pattern lines m=4, interval n=3). If n=3, in a group (block) discharged and formed by the nozzles, the post-treatment liquid 50L is discharged from the discharge ports (nozzles, printing nozzles) 50N of the same nozzle line and regularly arranged at 4/600 inch intervals in a linear manner.

In other words, in the head of the post-treatment liquid 50L, the m nozzle lines are arranged in the first direction and a plurality of nozzles included in the nozzle lines are arranged at different positions in the second direction.

The m nozzle lines correspond to the same number of the pattern lines (4 in FIG. 26). Each nozzle in the nozzle line discharges the post-treatment liquid 50L (transparent droplets) to form its respective pattern within the pattern line that corresponds to the nozzle line. Patterns formed in this manner are arranged at (m−1) intervals in the pattern line (3 intervals in FIG. 26). All patterns formed in all the pattern lines are formed at different positions in the first direction (Xm) and the second direction.

In accordance with this, if there is a curve or a missing portion in the block due to a non-discharge nozzle, this will be noticeably recognizable to the human eyes. Further, since this block corresponds to the nozzle line of the head, it is possible to readily recognize a non-discharge nozzle line.

In other words, if the interval n=a number of nozzle lines L−1, namely, if the number of the nozzle lines L is set to the interval n+1(L=n+1), a test pattern group (block) of the post-treatment liquid 50L is discharged from the discharge ports 50N of the corresponding nozzle line, so that it is possible to clearly specify the non-discharge nozzle and its nozzle line more easily.

Further, if the non-discharge nozzle is specified, a discharge recovery operation (maintenance) may be performed only on the specified non-discharge nozzle in the corresponding nozzle line. Accordingly, it is possible to reduce an amount of ink or a post-treatment liquid to be used for this operation.

While pattern lines of this example have the shape in Example 1-1, pattern lines having the shape in Example 1-2 or Example 1-3 may be applied.

Example 4

Serial Type Head

While the line type head is used as shown in FIG. 4A in the method for depositing the post-treatment liquid (transparent droplets) in the descriptions above, a serial type head may be used for a method for discharging the post-treatment liquid.

Figure 27A:
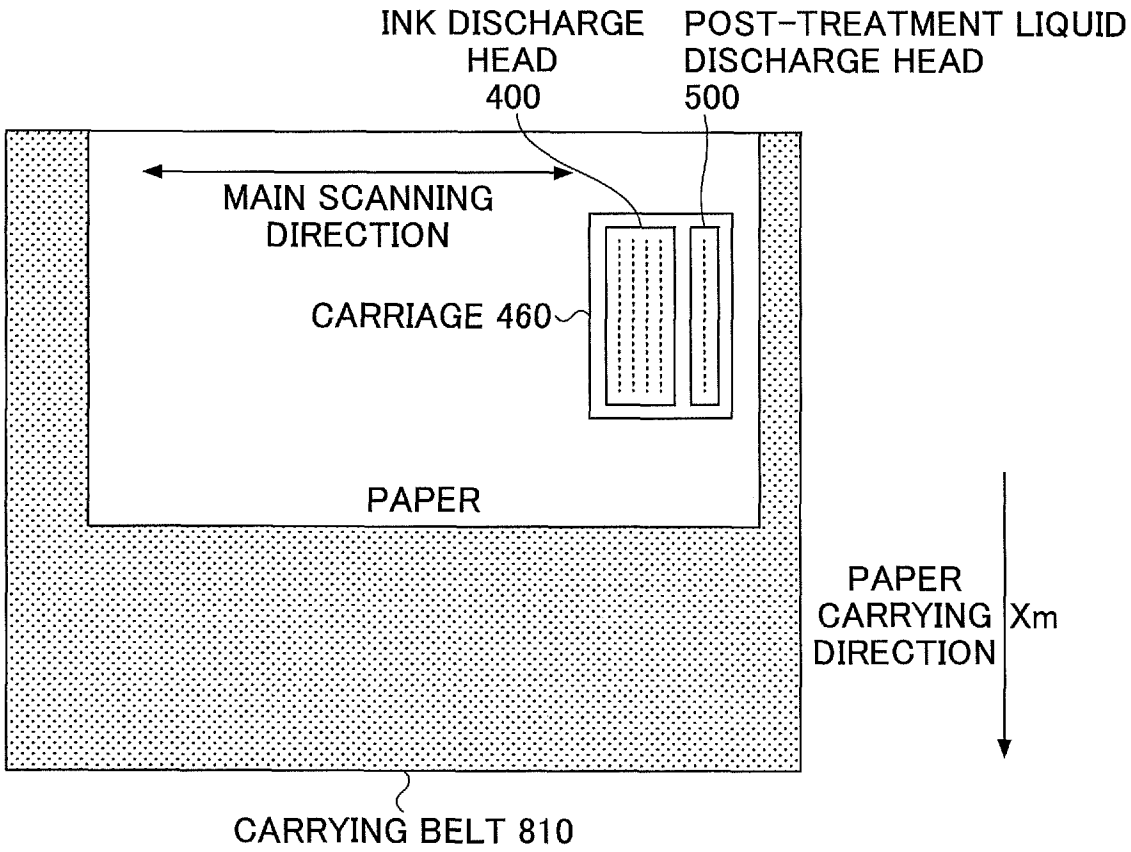
FIG. 27A is a schematic diagram illustrating use of a serial type head for a post-treatment liquid discharge unit of the image formation apparatus of FIG. 1.

FIG. 27A is a diagram illustrating a carriage 460 including nozzles of the serial type head and the carrying direction of the recording medium. In this example, the carriage 460 is moved in a direction orthogonal to the direction in which the recording medium is carried and the carriage 460 coats ink or a post-treatment liquid.

In this case, nozzle lines of an image formation unit (recording head) 400 serving as a recording head and a post-treatment unit 500 in the carriage 460 are extended in the carrying direction of the recording medium. The carriage 460 can move in a main scanning direction. In other words, the carriage 460 in which the discharge heads 40K-40Y (first discharge unit) serving as an image formation unit are integrated with a head of the post-treatment unit 500 (second discharge unit) moves relative to the recording medium (in a direction orthogonal to the carrying direction of the recording medium). In addition, while the image formation unit is integrated with the post-treatment unit in the serial type head in this example, the image formation unit and the post-treatment unit may be disposed on another carriage in the serial type head.

Figure 27B:
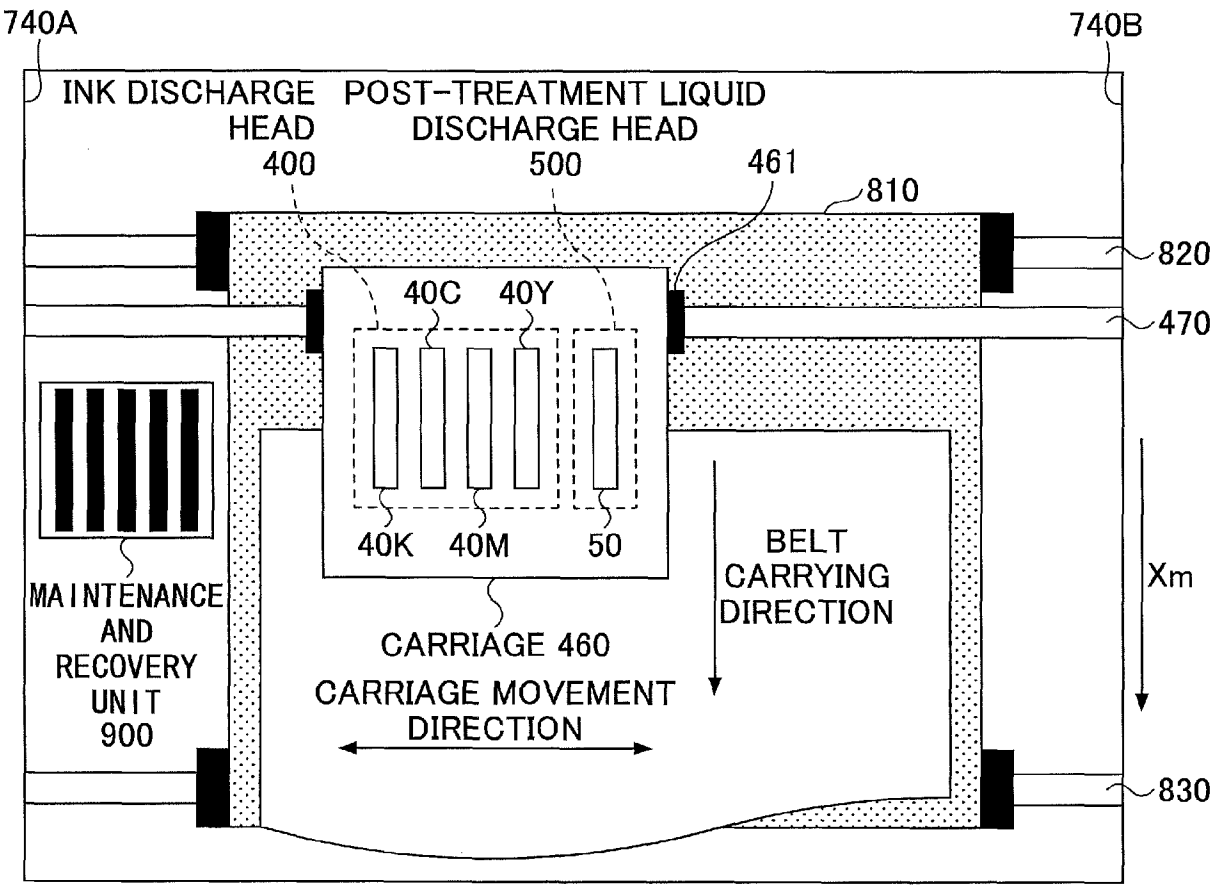
FIG. 27B is a top view illustrating use of a serial type head for the post-treatment liquid discharge unit of the image formation apparatus of FIG. 1.

FIG. 27B is a diagram showing a configuration around the carriage of the serial type head shown in FIG. 27A. A guide rod 470 serving as a main guide member laterally bridged between main side plates 740A and 740B which constitute a frame member of an apparatus body and a guide member (guide rod, guide stay, or the like) slidably hold the carriage 460 in the main scanning direction (longitudinal direction of the guide rod 470). The carriage 460 includes a main scanning motor, a driving pulley, a driven pulley, and a timing belt. The carriage 460 is disposed in the vicinity of a carriage driving unit 461 and is moved to perform scanning in the main scanning direction by a main scanning mechanism that drives the carriage driving unit 461.

On the carriage 460, the head 500 that discharges the post-treatment liquid 50L and the four recording heads 400 including a liquid discharge head whose subtanks are integrated and serving as an image formation unit that discharges black (K), cyan (C), magenta (M), and yellow (Y) ink droplets are installed. In the recording heads 400 and the head 500, nozzle lines including a plurality of nozzles are arranged in a sub-scanning direction orthogonal to the main scanning direction (relative movement direction) and installed such that droplets are discharged downward.

Below the carriage 460, a carrying belt 810 serving as a carrying unit that carries a recording medium such as paper in the sub-scanning direction is disposed. The carrying belt 810 is an endless belt and is stretched and installed between a carrying roller 820 and a tension roller 830 rotatably held between sub-side plates. The carrying belt 810 is rotated and moved in a direction Xm (belt carrying direction) shown by an arrow when the carrying roller 820 is rotatably driven by a sub-scanning motor. In accordance with this configuration, the carriage 460 can be moved in a direction (main scanning direction, first direction) orthogonal to the belt carrying direction, namely, the carrying direction of the recording medium.

Further, a maintenance and recovery unit 900 is disposed at one end outside a printing area in the main scanning direction. While the maintenance and recovery unit 900 is disposed at one end in FIG. 27B, maintenance and recovery units may be disposed at both ends outside the printing area depending on a purpose of use.

Figure 28:
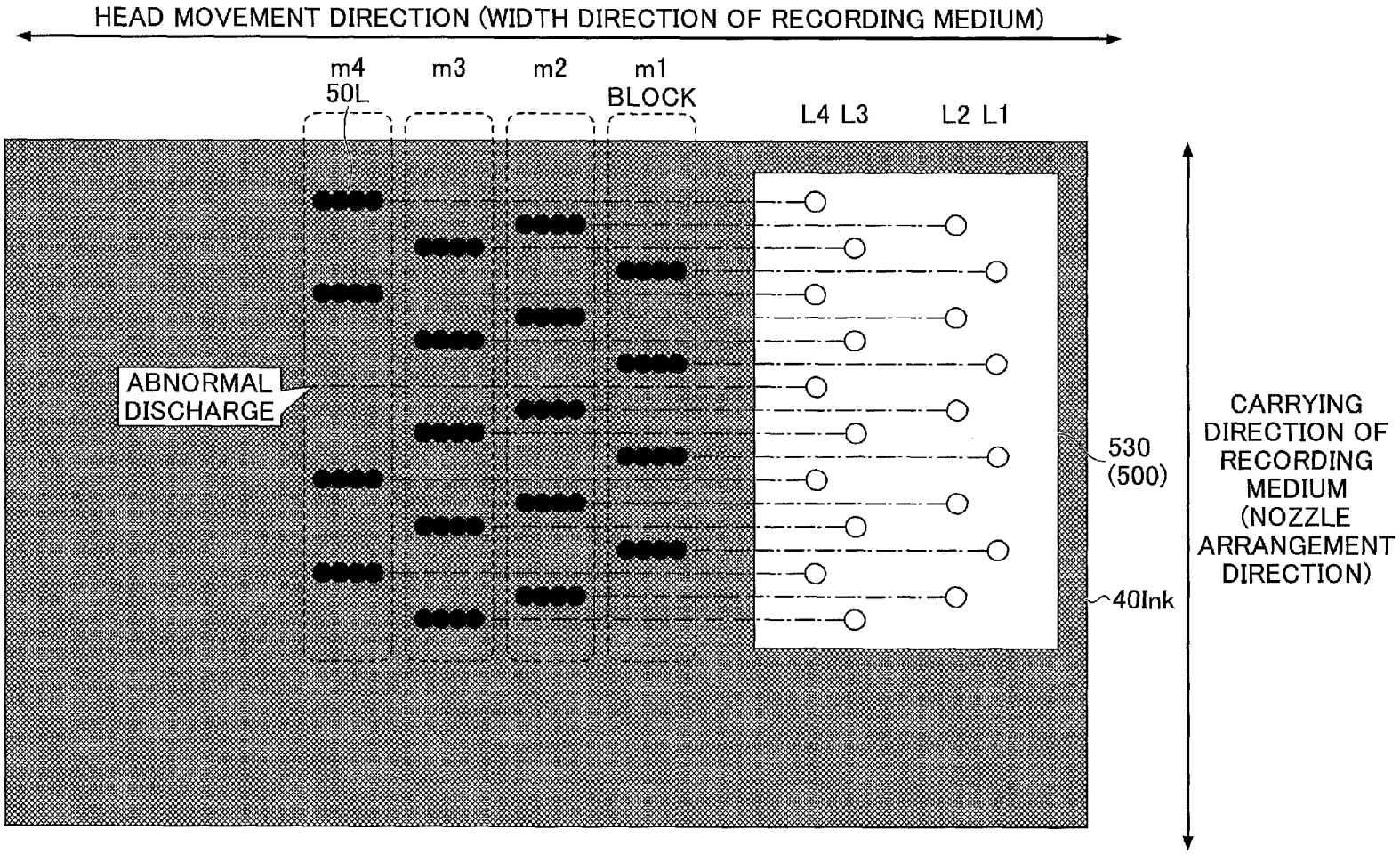
FIG. 28 is a diagram illustrating test patterns for a discharge examination of a post-treatment liquid discharge unit using the discharge head shown in FIGS. 27A and 27B.

FIG. 28 is a diagram illustrating test patterns for a discharge examination when control in Example 3 is applied to a serial type head. In FIG. 28, the configuration shown in FIG. 26 is employed as the serial type head in Example 3 in which a nozzle arrangement direction (second direction) is the same as the carrying direction of the recording medium. A difference from FIG. 26 is that the carriage 460 in which the heads are installed is movable in the main scanning direction.

The serial type head can include a plurality of discharge ports (nozzles, printing nozzles) 50N on an outer surface of the nozzle plate 53 in order to increase density of the nozzles and reduce a size thereof. In the nozzle lines, a plurality of nozzles are arranged in the second direction orthogonal to the first direction (carriage movement direction in this example) which is a relative movement direction with respect to the recording medium.

The plurality of discharge ports 50N are arranged in four lines in a longitudinal direction of a head unit 50-1 serving as the post-treatment unit 50 and constitute four nozzle lines. In these nozzle lines, the nozzles are disposed as shown in FIG. 25B such that the nozzle are arranged at regular intervals, such as 600 dpi, in the carrying direction of the recording medium.

FIG. 28 (n=3) is a diagram illustrating this configuration. On an area (solid area) filled with a single color using color ink (40Ink), test patterns are printed by discharging the post-treatment liquid from the head of this example. If n=3, in a group (block) discharged and formed by the nozzles, the post-treatment liquid 50L is discharged from the discharge ports (nozzles, printing nozzles) 50N of the same nozzle line and regularly arranged at 4/600 inch intervals in a linear manner. In accordance with this, if there is a curve or a missing portion in the block due to a non-discharge nozzle, this will be noticeably recognizable to the human eyes. Further, since this block corresponds to the nozzle line of the head, it is possible to readily recognize a non-discharge nozzle line.

In other words, if the interval n=a number of nozzle lines L−1, namely, if the number of the nozzle lines L is set to the interval n+1(L=n+1), a test pattern group (block) of the post-treatment liquid 50L is discharged from the discharge ports 50N of the corresponding nozzle line, so that it is possible to clearly specify the non-discharge nozzle and its nozzle line more easily. Further, if the non-discharge nozzle is specified, a discharge recovery operation (maintenance) may be performed only on the specified non-discharge nozzle in the corresponding nozzle line. Accordingly, it is possible to reduce an amount of ink or a post-treatment liquid to be used for this operation.

In this description, control in Example 3 where a plurality of nozzle lines are formed is applied to the serial type head. However, control in Example 1 or control in Example 2 where a single nozzle line is formed may be applied to the serial type head.

While pattern lines of this example have the shape in Example 1-1, pattern lines having the shape in Example 1-2 or Example 1-3 may be applied.

When the serial type head is used, since the head can be moved in the direction orthogonal to the carrying direction of the recording medium, ink droplets may not be discharged onto an entire area in the width direction of the recording medium which is a head movement direction but an image may be formed only on an area to be used to detect an abnormal discharge.

In the above-mentioned embodiments and examples, the image formation apparatus includes the carrying-in unit 10, the pretreatment unit 20, the pretreatment drying unit 31, the image formation unit 40, the post-treatment unit 50, the maintenance and recovery units 90A and 90B, the post-treatment drying unit 32, and the carrying-out unit 60. However, each element may be configured as a separate device and such devices may be combined to form a system. For example, an image formation system includes, in an operably connected manner, a pretreatment device, a pretreatment drying device, an image formation device, a post-treatment device, a maintenance and recovery device, a post-treatment drying device, and a carrying-out device, the devices being independent of one another.

Although preferred embodiments and examples of the present invention are described above, the present invention is not limited to the above-mentioned embodiments and examples. Further, the present invention can be varied or modified in various manners in light of the attached claims.

For example, in addition to an image formation apparatus, the present invention can be applied to any one of a printer, a scanner, a copier, a plotter, a facsimile machine, and the like as long as a discharger (discharge head, ink head, recording head, ink jet, or the like) discharges droplets (such as ink) and forms (printing, picture printing, character printing, recording, or the like) an image on a surface of a recording medium.

Further, the present invention is not limited to these embodiments, and various variations and modifications may be made without departing from the scope of the present invention.

What is claimed is:

1. An image formation apparatus comprising:

a first discharge unit including a first nozzle line having a plurality of nozzles, the first nozzle line discharging color droplets to form a predetermined image on a recording medium, the first discharge unit moving relative to the recording medium; and a second discharge unit including a second nozzle line that discharges transparent droplets on the recording medium on which the predetermined image is formed, the second discharge unit moving in a first direction relative to the recording medium, and the second nozzle line having a plurality of nozzles arranged in a second direction orthogonal to the first direction, wherein when a discharge operation of the second discharge unit is examined, after the predetermined image is formed with the color droplets discharged by the first discharge unit, the second discharge unit discharges the transparent droplets from two or more of the nozzles thereof spaced at m−1 nozzle intervals in the second direction to form a row of dots extending in the second direction, and repeats forming the row while successively moving in the first direction relative to the recording medium so as to form m rows arranged side by side in the first direction, positions of the discharging nozzles being successively shifted together by one nozzle in the second direction upon a successive movement of the second discharge unit relative to the recording medium in the first direction, such that the dots in each of the rows are formed at m−1 nozzle intervals, and positions of the dots in an n-th one of the rows are displaced together by one nozzle in the second direction relative to positions of the dots in an n−1-th one of the rows.

2. The image formation apparatus as claimed in claim 1, wherein the second discharge unit includes m second nozzle lines in the first direction and the plurality of nozzles included in the m second nozzle lines are arranged at different positions in the second direction.

3. The image formation apparatus as claimed in claim 2, wherein the m second nozzle lines correspond to the m rows, the nozzles in the m second nozzle lines discharge the transparent droplets to form dots in the corresponding m rows, such that the dots are formed at m−1 nozzle intervals in each of the m rows and the dots in the m rows are formed at different positions in the first direction and the second direction.

4. The image formation apparatus as claimed in claim 1, wherein the predetermined image formed with the color droplets discharged by the first discharge unit is a solid image formed in an area where the m rows of the transparent droplets are formed and in a peripheral part of the m rows.

5. The image formation apparatus as claimed in claim 1, wherein the predetermined image formed with the color droplets discharged by the first discharge unit is a single-color image.

6. The image formation apparatus as claimed in claim 1, wherein an image density of the predetermined image formed with the color droplets discharged by the first discharge unit ranges from not less than 0.2 to not more than 2.0 relative to the recording medium.

7. The image formation apparatus as claimed in claim 1, further comprising:

a maintenance and recovery unit that maintains and recovers a nozzle of abnormal discharge if there is an abnormal discharge of the transparent droplets based on the dots formed with the transparent droplets discharged by the second discharge unit.

8. The image formation apparatus as claimed in claim 7, wherein the abnormal discharge of the transparent droplets is determined based on information input by a user who visually examines the dots.

9. The image formation apparatus as claimed in claim 1, wherein the first discharge unit includes a plurality of first pressure chambers in communication with the plurality of nozzles of the first nozzle line and includes a plurality of first piezoelectric elements that face the plurality of nozzles, the plurality of the first piezoelectric elements pressurizing a color liquid within the first pressure chambers to discharge the color droplets, and the second discharge unit includes a plurality of second pressure chambers in communication with the plurality of nozzles of the second nozzle line and includes a plurality of second piezoelectric elements that face the plurality of nozzles, the plurality of the second piezoelectric elements pressurizing a transparent liquid within the second pressure chambers to discharge the transparent droplets, the image formation apparatus further comprising:

a first driving waveform creation unit that creates and applies a first driving waveform for continuously discharging droplet dots to the plurality of the first piezoelectric elements; and a second driving waveform creation unit that creates and applies a second driving waveform for discharging a predetermined number of transparent droplets to the plurality of the second piezoelectric elements, wherein when the discharge operation of the second discharge unit is examined, after the predetermined image is formed with the color droplets discharged by the first discharge unit when the first driving waveform creation unit applies the first driving waveform to the plurality of the first piezoelectric that face the plurality of nozzles in the first nozzle line of the first discharge unit, the second driving waveform creation unit applies the second driving waveform to the second piezoelectric elements spaced at m−1 nozzle intervals in the second nozzle line of the second discharge unit, the second piezoelectric elements spaced at m−1 nozzle intervals facing the nozzles spaced at m−1 nozzle intervals, such that a first row of dots extending in the second direction is formed, and the second driving waveform creation unit successively shifts positions of applied second piezoelectric elements together by one nozzle in the second direction and applies, m times in total, while the second discharge unit successively moves in the first direction relative to the recording medium, the second driving waveform to the second piezoelectric elements in the second nozzle line of the second discharge unit, at a time different from a time when the second driving waveform is applied to the second piezoelectric elements spaced at m−1 nozzle intervals that face the nozzles spaced at m−1 nozzle intervals, such that rows of dots are successively formed in the first direction, thereby forming the m rows.

10. The image formation apparatus as claimed in claim 9, wherein if the m rows of the transparent droplets formed on the predetermined image of color droplets are not visually recognizable to a user, when the discharge operation of the second discharge unit is examined, the second driving waveform creation unit increases amplitude of the second driving waveform such that a dot diameter of transparent droplets to be discharged becomes larger.

11. The image formation apparatus as claimed in claim 9, wherein if the m rows of the transparent droplets formed on the predetermined image of color droplets are not visually recognizable to a user, when the discharge operation of the second discharge unit is examined, the second driving waveform creation unit increases a frequency of the second driving waveform such that the m rows are formed with an increased number of transparent droplets more than the predetermined number of transparent droplets.

12. A method for examining a discharge of transparent droplets in an image formation apparatus, the image formation apparatus including a first discharge unit having a plurality of first pressure chambers in communication with a plurality of nozzles of a first nozzle line and having a plurality of first piezoelectric elements that face the plurality of nozzles and pressurize a color liquid within the first pressure chambers to discharge color droplets, the first discharge unit discharging the color droplets onto a recording medium to form a predetermined image, the first discharge unit moving relative to the recording medium; and a second discharge unit having a plurality of second pressure chambers in communication with a plurality of nozzles of a second nozzle line and having a plurality of second piezoelectric elements that face the plurality of nozzles and pressurize a transparent liquid within the second pressure chambers to discharge transparent droplets, the second nozzle line discharging the transparent droplets onto the recording medium on which the predetermined image is formed with the color droplets, the second discharge unit moving in a first direction relative to the recording medium, and the second nozzle line having the plurality of nozzles arranged in a second direction orthogonal to the first direction, the method for examining a discharge of transparent droplets comprising:

forming the predetermined image with the color droplets discharged by the first discharge unit by applying a first driving waveform for continuously discharging droplet dots to the plurality of the first piezoelectric elements that face the plurality of nozzles in the first nozzle line of the first discharge unit; and after the predetermined image is formed with the color droplets, forming m rows of dots by applying a second driving waveform for discharging a predetermined number of transparent droplets to the second piezoelectric elements spaced at m−1 nozzle intervals in the second nozzle line of the second discharge unit, the second piezoelectric elements spaced at m−1 nozzle intervals facing nozzles spaced at m−1 nozzle intervals, such that a first row of dots extending in the second direction is formed, and by successively shifting positions of applied second piezoelectric elements together by one nozzle in the second direction and applying, m times in total, while the second discharge unit successively moves in the first direction relative to the recording medium, the second driving waveform to the second piezoelectric elements in the second nozzle line of the second discharge unit, at a time different from a time when the second driving waveform is applied to the second piezoelectric elements spaced at m−1 nozzle intervals that face the nozzles spaced at m−1 nozzle intervals, such that the m rows are successively formed side by side in the first direction, the dots in each of the rows are formed at m−1 nozzle intervals, and positions of the dots in an n-th one of the rows are displaced together by one nozzle in the second direction relative to positions of the dots in an n−1-th one of the rows.

13. A non-transitory computer-readable recording medium storing a computer-readable program that, when executed by a computer, causes the computer to perform the method for examining a discharge of transparent droplets as claimed in claim 12.

* * * * *